US011208871B2

(12) United States Patent
Shpak et al.

(10) Patent No.: US 11,208,871 B2
(45) Date of Patent: Dec. 28, 2021

(54) APPARATUS, SYSTEMS AND METHODS FOR COMPLETION OPERATIONS

(71) Applicant: KOBOLD CORPORATION, Calgary (CA)

(72) Inventors: Vitaliy Shpak, Calgary (CA); Matthew Brown, Calgary (CA); Mark Andreychuk, Calgary (CA); Per Angman, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 0 days.

(21) Appl. No.: 16/921,696

(22) Filed: Jul. 6, 2020

(65) Prior Publication Data

US 2021/0002980 A1 Jan. 7, 2021

Related U.S. Application Data

(60) Provisional application No. 62/870,518, filed on Jul. 3, 2019.

(51) Int. Cl.
*E21B 34/14* (2006.01)
*E21B 23/00* (2006.01)

(52) U.S. Cl.
CPC ..... *E21B 34/14* (2013.01); *E21B 23/006* (2013.01); *E21B 2200/06* (2020.05)

(58) Field of Classification Search
CPC ..... E21B 23/006; E21B 34/14; E21B 2200/06
See application file for complete search history.

(56) References Cited

U.S. PATENT DOCUMENTS 5,156,210 A * 10/1992 Roth ..... E21B 34/10 166/319
10,472,928 B2 * 11/2019 Andreychuk ..... E21B 23/006
2017/0058644 A1 * 3/2017 Andreychuk ..... E21B 34/14

* cited by examiner

*Primary Examiner* — Cathleen R Hutchins
(74) *Attorney, Agent, or Firm* — Parlee McLaws LLP; Andrew C F Lau

(57) ABSTRACT

A bottomhole assembly (BHA) having a shifting tool and housing for shifting an uphole-to-open sleeve of a sleeve of a shorter length downhole sleeve assembly to an open position, and optionally to a closed position. Sleeve-engaging elements of the BHA are coordinated to direct the sleeve-engaging elements into a tool-engaging profile of the sleeve, excluding other annular variations in the casing string. The BHA has an improved dual J-Mechanism situated between the shifting tool and housing to permit new additional shifting options which results in fewer overall shifting cycles of the BHA when used with the shift uphole-to-open, shorter-length sleeve assembly. The shortened sleeve assembly is incorporated into a casing string and is relatively short in length when compared with conventional sleeve assemblies.

22 Claims, 16 Drawing Sheets

126
124
150
146/148
144
D1
152
122
140/142
130
138
136
176
114
164
174
162
160
8
RIH
U1
PTL
154
PULL TO OPEN
RIHBe Stop
RIHBe
D2H
RIH BELOW PORTS
F
FRAC

Fig. 7Bii

Fig. 7Gii 144
150
122
142
124
126
122
RIH 1

144
150
148
PTL 1

144
150
PTL 2
Fig. 8Bii
2
144
150
PTL 3
OPEN
SLEEVE

144
RIHBe
150

144
RIHBe
150
RIH TO
SET
BELOW
3a
Fig. 8Dii
144
150
SET
BELOW
3b

144
RET
150
PULL TO
RELOCATE
4

144
150
SET TO
CLOSE
5

P
144
150
SLEEVE
CLOSED
Fig. 8Gii
144
150
POOH 6

144
150

APPARATUS, SYSTEMS AND METHODS FOR COMPLETION OPERATIONS

CROSS-REFERENCE TO RELATED APPLICATIONS

This application claims the benefit of U.S. Provisional Application 62/870,518, filed Jul. 3, 2019, the entirety of which is incorporated fully herein by reference.

FIELD

Embodiments taught herein relate to apparatus, systems, and methods for use in completion operations and, more particularly, to apparatus and methods for opening ports in a tubular string in a wellbore, such as opening the ports of shifting sleeve assemblies.

BACKGROUND

Conventional sleeve assemblies are located along a wellbore tubular, such as a casing string completed in a wellbore, to selectably prevent and permit fluid flow between the wellbore and the surrounding formation. Each sleeve assembly is actuable between a closed position and an open position using a tubing-conveyed tool. In the closed position, a tubular sleeve of the sleeve assembly covers ports formed in a sleeve housing of the sleeve assembly to block flow of fluids through the ports. In the open position, the sleeve is axially displaced to uncover the ports, thereby permitting the flow of fluids through the sleeve housing.

The sleeves of sleeve assemblies can be configured to be open-only (single-shift) or can be capable of being both opened and closed (closeable). Whether single-shift or closeable, prior art sleeves are generally shifted downhole to the open position.

Several challenges occur with sleeves that are shifted downhole to open: firstly, as the length of the wellbore increases, it becomes proportionately difficult to apply a downhole force to the tool conveyance string sufficient to shift the sleeve to the open position, particularly with deviated or horizontal wellbores; and secondly, the sleeves are susceptible to being inadvertently engaged by downhole tools as they are run-in-hole (RIH). Aggressive shoulders or other protrusions of the tool can accidentally engage with the sleeve and, if sufficient force is applied, can shift the sleeve downhole to the open position and expose the ports. In some cases, with prior art sleeve assemblies, the unintentional shifting of a sleeve to the open position may not be detected at surface as the tool is RIH, and the accidental shifting of the sleeve is only discovered later when casing pressurization tests fail, or fluid is released to the formation at an unplanned location or zone therein. The accidentally opened sleeve must then be re-closed, if the sleeve is closeable, which is a time-consuming and costly process.

Conventional sleeve assemblies and the shiftable sleeves therein are typically relatively long, such as ranging from about 26 to about 30 inches long (about 66 cm to about 76 cm), and in some cases are many feet in length. Such sleeve lengths are required to permit positioning of a shifting tool, or other tool, with the sleeve and engagement of the tool with the sleeve at a location intermediate the length of the sleeve. Further, additional lengths of tubulars such as pup joints may also be prepended and appended to the sleeve assembly to aid in properly positioning and operating bottomhole assemblies (BHA) and shifting tools therewith, thus adding additional length. Additional length translates into increased manufacturing cost for each sleeve assembly. Moreover, longer sleeve assemblies are more difficult to handle in transport and assembly.

Moreover, manipulation of sleeves using a shifting tool has often necessitated long sleeves so as to permit uphole and downhole movement of the sleeve and enable opening and closing thereof. Long sleeves are specialty connectors, and conventional casing collars are provided for the regular spaced connection of lengths of the casing, further adding to the expense of the casing string.

There is interest in the oil and gas industry for sleeve assemblies that are shorter in length, relatively simple in design, have a low cost, and which can be efficiently and reliably shifted to open and close ports, such as for fracturing operations.

One challenge with implementing shorter-length sleeves is that it is difficult to operate conventional shifting tools to shift such sleeves to the open and closed positions. For example, with reference to the shifting tool disclosed in Applicant's U.S. Pat. No. 10,472,928, issued Nov. 12, 2019 and incorporated herein in its entirety, the shifting tool is configured to be actuated to a sleeve profile-engaged position after locating a selected sleeve and shift the sleeve downward to the open position. Once the sleeve has been shifted to the open position, the weight of the conveyance string is set on the shifting tool to drive a cone of the shifting tool into the pivotable arms thereof to drive dogs of the arms into the sleeve and compress one or more packers to engage with the sleeve downhole of the ports of the sleeve housing. Fluid can then be introduced into the wellbore and directed out of the ports, the packers of the shifting tool preventing fluid from flowing further downhole. It would be difficult to use such a shifting tool to manipulate a shorter-length sleeve, as the sleeve does not have sufficient length to accommodate the dogs and packers of the tool. Specifically, the packers of the shifting tool would have to be set below the short sleeve assembly, necessitating additional cycling of the shifting tool to release the arms thereof after opening the sleeve to permit the tool to be RIH further downhole to position the packers below the sleeve assembly, and then cycled even further to re-set the dogs and packers in order to frac the formation through the ports of the sleeve assembly.

Thus, there is a need for a shifting tool capable of reliably locating and actuating shorter-length sleeves without unnecessary cycling thereof.

SUMMARY

Herein, a suitable bottomhole assembly (BHA) having a shifting tool and housing is provided for shifting an uphole-to-open sleeve of a sleeve assembly to an open position, and for controlling the optional closing thereof. Sleeve-engaging elements of the BHA are coordinated to direct the sleeve-engaging elements into a tool-engaging profile of the sleeve, excluding other annular variations in the casing string. The BHA has an improved dual J-Mechanism to permit new additional shifting options which results in fewer overall shifting cycles of the BHA when used with the shift uphole-to-open, shorter-length sleeve assembly disclosed herein. The J-Mechanism is situated between the shifting tool and housing.

The uphole-opening sleeve assembly is incorporated into a casing string and is relatively short in length when compared with conventional sleeve assemblies. The sleeve of the sleeve assembly has sufficient length to accommodate the tool-engaging profile, and need not include any additional axial real estate for accommodating sealing elements, anchors, or other components of the BHA besides the sleeve-engaging elements thereof. Thus, the sleeve can be very short with commensurate cost savings and ease of handling. The use of the tool-engaging profile in the sleeve, in combination with the BHA disclosed herein, renders the sleeve closeable. This closeable, short sleeve assembly (CSS) can be actuated at least once between open and closed positions, or can be actuated repeatedly between open and closed positions.

In a general embodiment, a BHA and method of operation of the BHA and sleeve assembly is provided using a BHA shifting tool and housing, and a J-Mechanism therebetween, that permits engagement and shifting up of a sleeve of a sleeve assembly to open ports, and subsequently to set a sealing element of the shifting tool in the casing below the opened sleeve assembly for applying a fluid treatment therethough. Excess cycling of the BHA conveyance string is avoided after opening while enabling repositioning of the sealing element below the sleeve assembly to enable set, and treatment or fracing, mode (SET-FRAC). The J-Mechanism enables reliable repositioning of the sealing element below the sleeve assembly without prematurely actuating the BHA's sealing element in the recently-opened sleeve assembly. The sleeve assembly can also, as desired, be actuated downhole to close the ports thereof such as after a hydraulic fracturing treatment.

In one embodiment, shifting of the BHA tool downhole to the SET-FRAC mode collapses a first uphole housing of the BHA housing into a second downhole housing portion, movement of the second housing portion resisted by the drag block for repositioning of the sealing elements below the sleeve assembly, the axial stroke of the collapsing housing sufficient to position the shifting tool's sealing element downhole of the sleeve assembly.

In one embodiment, the BHA includes first and second housing portions telescopically coupled together and having respective first and second J-Mechanisms that cooperate with first and second J-Pins of a common mandrel of the BHA to enable positioning of sealing elements of the BHA below a sleeve assembly after the BHA has opened the sleeve thereof. The dual J-Mechanisms permit the BHA to reposition below the sleeve assembly without actuating the sealing elements prematurely in the sleeve assembly and with relatively few actuations of the J-Mechanisms. The second housing portion is located downhole of the first housing portion and the housing portions together form a slack sub to enable selective engagement of the second J-Pin with the second J-Mechanism. The second J-Profile of the second J-Mechanism is telescopically reciprocated into and out of engagement with the second J-Pin of the BHA mandrel. As mentioned above, the BHA mandrel is further fit with a sealing element, such as a resettable packer, and a cone configured to engage with one or more arms supported by the first housing portion. The sleeve-engaging elements are located on the arms and can be dogs or other suitable structures. The second J-Mechanism axially spaces the cone from the arms during lowering of the BHA below the sleeve assembly before the first J-Mechanism is cycled to a set and fracturing mode, at which point the second J-Mechanism permits the cone to engage the arms to lock the dogs in the profile of the sleeve and set the sealing elements against the casing downhole of the sleeve assembly.

A short, closeable, uphole-to-open sleeve assembly and an improved BHA configured to actuate to sleeve assembly provide a system and methodology for a low cost, effective multi-stage fracturing system.

In a broad aspect, a shifting tool for sleeve valves along a wellbore is provided, each sleeve valve having a sleeve housing having a bore fit with an axially shiftable sleeve within, the sleeve having an annular sleeve profile formed therealong, the shifting tool comprising: a first housing portion having a first shifting mechanism; a second housing portion having a second shifting mechanism, the second housing portion telescopically connected to the first housing portion and adapted for axially telescoping between a collapsed position and an extended position; a drag block connected to the second housing portion and adapted for resisting axial movement the second housing portion in the wellbore; a mandrel having a first shifting member adapted to cooperate with the first shifting mechanism, a second shifting member adapted to selectably cooperate with the second shifting mechanism, and a retaining member; one or more sleeve engagement members supported on one or more pivotable arms, the one or more arms supported by the first housing portion, each of the one or more pivotable arms being radially actuable by the retaining member between at least a radially outward position and a radially inward collapsed position.

In an embodiment, the first shifting mechanism and second shifting mechanism cooperate to delineate a plurality of operational modes of the shifting tool.

In an embodiment, the mandrel comprises one or more sealing elements and a cone, and the plurality of operational modes comprises at least:

a run-in-hole (RIH) mode, wherein the first shifting member is at a first intermediate downhole position to shift the one or more arms to the radially inward position;

a pull-to-locate (PTL) mode, wherein the first shifting member is at a first extreme uphole position to shift the one or more arms to the radially outward position;

a RIHBe mode, wherein the first shifting member is at a second intermediate downhole position and engaged with a RIHBe stop of the first shifting mechanism to actuate the first housing portion to the collapsed position and position the one or more sealing elements downhole of the sleeve valve;

a SET-FRAC mode, wherein the first shifting member is at an extreme downhole position to drive the cone into the one or more pivotable arms radially outward and activate the one or more sealing elements;

a pull-to-relocate (PTR) mode, wherein the first shifting member is located at a second extreme uphole position to shift the one or more pivotable arms to the radially outward position, and the second shifting member engages a retaining stop of the second shifting mechanism to maintain the first housing portion in the collapsed position;

a SOFT-SET-CLOSE mode, wherein the first shifting member is located at a near-extreme downhole position to partially activate the one or more sealing elements; and a pull-out-of-hole (POOH) mode, wherein the first shifting member is at an intermediate uphole position to shift the one or more pivotable arms to the radially inward position for pulling out of hole.

In an embodiment, a stroke length travelled by the first housing portion when actuating between the extended position and the collapsed position is sufficient for the one or more sealing elements to be axially positioned downhole of the sleeve valve when the shifting tool has located the sleeve valve and is actuated from the extended position to the collapsed position.

In an embodiment, the stroke length is equal to or greater than an axial distance between the one or more sealing elements and the ports immediately after the shifting tool has actuated the sleeve to an open position.

In an embodiment, the plurality of operational modes comprise at least one mode wherein the second shifting member is not engaged with the second shifting mechanism to allow the first and second housing portions to telescope freely between the collapsed and extended positions.

In an embodiment, the plurality of operational modes comprise at least one mode wherein the second shifting member is engaged with one or both of the second shifting mechanism and the second housing portion to maintain the first and second housing portions in the collapsed position.

In an embodiment, the activation mandrel is connected to a conveyance string and axially manipulated thereby, the activation mandrel extending slidably through the upper housing and lower housing.

In an embodiment, the first and second shifting mechanisms are first and second J-Mechanisms having respective first and second J-Profiles, and the first and second shifting members are first and second J-Pins connected to the mandrel and engaging with the first and second J-Profiles.

In another broad aspect, a method for treating a wellbore completed with a completion string having a plurality of sleeve valves therealong is provided, each sleeve valve having a sleeve housing and an axially shiftable sleeve, each sleeve having an annular profile intermediate the sleeve, comprising: selecting a target sleeve valve for treatment, the target sleeve valve being closed; running a shifting tool downhole in a run-in-hole (RIH) mode by actuating a mandrel axially relative to a housing portion, the housing portion supporting one or more radially pivotable arms, each arm bearing a sleeve engaging member, and a drag block connected to the housing portion and adapted for resisting axial movement of the housing portion in the wellbore, the one or more pivotable arms shifted to a radially inward position and positioning the shifting tool downhole of the selected sleeve valve; shifting the shifting tool uphole to a pull-to-locate (PTL) mode, the one or more pivotable arms shifted to a radially outward biased position, locating the annular profile of the sleeve of the target sleeve valve and engaging the sleeve engaging elements therewith, and shifting the target sleeve valve uphole to an open position; shifting the shifting tool downhole to a SET-FRAC mode, the housing portion actuated to position one or more sealing elements of the shifting tool downhole of the target sleeve valve for treating the wellbore; shifting the shifting tool uphole to a pull-to-relocate (PTR) mode, the one or more pivotable arms shifted to the radially outward biased position, and pulling the shifting tool uphole for locating the annular profile of the sleeve of the target sleeve valve and engaging the sleeve engaging elements therewith; shifting the shifting tool downhole to a SOFT-SET-CLOSE mode, the one or more sealing elements partially activated and the sleeve-engaging elements locked in engagement with the target sleeve; applying fluid pressure in an annulus between the shifting tool and the completion string to apply a downhole force on the shifting tool to shift the target sleeve valve to a closed position; and shifting the tool to a pull-out-of-hole (POOH), the one or more arms in the radially inward collapsed position for pulling the shifting tool out of hole to a subsequent uphole sleeve valve.

In an embodiment, the shifting the shifting tool downhole to the SET-FRAC mode for actuating the housing portion to position one or more sealing elements of the shifting tool downhole of the target sleeve valve further comprises telescopically collapsing a first uphole housing portion of the housing portion into a second downhole housing portion, movement of the second housing portion resisted by the drag block; and shifting of the shifting tool uphole to the PTL mode further comprises telescopically extending the first uphole housing of the housing portion from the second downhole housing portion, movement of the second housing portion resisted by the drag block.

In an embodiment, a stroke length of the axial collapsing of the first uphole housing portion into second downhole housing portion is sufficient for positioning the one or more sealing elements of the shifting tool downhole of the target sleeve valve In another broad aspect, a treatment system is provided comprising: a completion string having a plurality of sleeve valves therealong, each sleeve valve having a sleeve housing having one or more ports and a bore fit with an axially shiftable sleeve, each sleeve having an annular profile formed intermediate the sleeve; and a shifting tool having: a first housing portion having a first shifting mechanism; a second housing portion having a second shifting mechanism, the second housing portion telescopically connected to the first housing portion and adapted for axially telescoping between a collapsed position and an extended position; a drag block connected to the second housing portion and adapted for resisting axial movement the second housing portion in the wellbore; a mandrel having a first shifting member adapted to cooperate with the first shifting mechanism, a second shifting member adapted to selectably cooperate with the second shifting mechanism, a retaining member, one or more sealing elements, and a cone; and one or more sleeve engagement members supported on one or more pivotable arms, the one or more arms supported by the first housing portion, each of the one or more pivotable arms being radially actuable by the retaining member between at least a radially outward position and a radially inward position.

In an embodiment, the axial length of the sleeve valve is less than the combined axial length of the one or more sealing elements, the cone, and the one or more sleeve engagement members.

In an embodiment, the first shifting mechanism and second shifting mechanism cooperate to delineate a plurality of operational modes of the shifting tool.

In an embodiment, the plurality of operational modes comprises at least: a run-in-hole (RIH) mode, wherein the first shifting member is at a first intermediate downhole position to shift the one or more arms to the radially inward position; a pull-to-locate (PTL) mode, wherein the first shifting member is at a first extreme uphole position to shift the one or more arms to the radially outward position; a RIHBe mode, wherein the first shifting member is at a second intermediate downhole position and engaged with a RIHBe stop of the first shifting mechanism to actuate the first housing portion to the collapsed position and position the one or more sealing elements downhole of the sleeve valve; a SET-FRAC mode, wherein the first shifting member is at an extreme downhole position to drive the cone into the one or more pivotable arms radially outward and activate the one or more sealing elements; a pull-to-relocate (PTR) mode, wherein the first shifting member is located at a second extreme uphole position to shift the one or more pivotable arms to the radially outward position, and the second shifting member engages a retaining stop of the second shifting mechanism to maintain the first housing portion in the collapsed position; a SOFT-SET-CLOSE mode, wherein the first shifting member is located at a near-extreme downhole position to partially activate the one or more sealing elements; and a pull-out-of-hole (POOH)

mode, wherein the first shifting member is at an intermediate uphole position to shift the one or more pivotable arms to the radially inward position for pulling out of hole.

In an embodiment, a stroke length travelled by the first housing portion when actuating between the extended position and the collapsed position is sufficient for the one or more sealing elements to be axially positioned downhole of the sleeve valve when the shifting tool has located the sleeve valve and is actuated from the extended position to the collapsed position.

In an embodiment, the stroke length is equal to or greater than an axial distance between the one or more sealing elements and the ports immediately after the shifting tool has actuated the sleeve to an open position.

In an embodiment, the plurality of operational modes comprise at least one mode wherein the second shifting member is not engaged with the second shifting mechanism to allow the first and second housing portions to telescope freely between the collapsed and extended positions.

In an embodiment, the plurality of operational modes comprise at least one mode wherein the second shifting member is engaged with one or both of the second shifting mechanism and the second housing portion to maintain the first and second housing portions in the collapsed position.

In an embodiment, the activation mandrel is connected to a conveyance string and axially manipulated thereby, the activation mandrel extending slidably through the upper housing and lower housing.

In an embodiment, the first and second shifting mechanisms are first and second J-Mechanisms having respective first and second J-Profiles, and the first and second shifting members are first and second J-Pins connected to the mandrel and engaging with the first and second J-Profiles.

BRIEF DESCRIPTION OF THE DRAWINGS

FIG. 6A illustrates the shifting tool in a run-in-hole (RIH) mode of the uphole J-Mechanism of the shifting tool for locating the tool at a position, in the casing, downhole of the selected sleeve assembly;

FIG. 6B illustrates the shifting tool being pulled uphole-to-locate (PTL) the sleeve in the selected sleeve assembly guided by the uphole J-Mechanism, the shifting tool dogs shown engaging a profile in the sleeve;

FIG. 6C illustrates the shifting tool remaining in the PTL mode for pulling the sleeve uphole to the open position;

FIG. 6D illustrates the cycling of the uphole J-Mechanism for RIH downhole repositioning of the shifting tool packer in the casing below the sleeve assembly, initially without actuating the packer, for isolating the wellbore therebelow in preparation for hydraulic fracturing, noting the uphole and downhole J-Mechanisms restraining the mandrel and housing coupling mid-cycle to space the mandrel, with the packer cone combination, from the dogs until a bottom of the stroke actuates the downhole J-Mechanism to release the J-mandrel from the uphole J-Mechanism;

FIG. 6E illustrates setting down on the shifting tool (SET/FRAC) for utilizing the uphole J-Mechanism to engage the cone and dogs, to set the dogs as slips against the casing and sealing the packer across the casing for introducing frac fluid through the open ports;

FIG. 6F illustrates the shifting tool being pulled uphole to actuate the uphole J-Mechanism to the pull-to-relocate (PTR) mode to re-locate the sleeve in the selected sleeve assembly, the dogs engaged with the sleeve for a subsequent shifting operation;

FIG. 6G illustrates the sleeve engaged with the dogs and cycled to partially actuate the packer (SOFT SET/CLOSE) and using pump fluid pressure on the partially expanded packer to pump down the packer and whole of the BHA to close the sleeve and fluid ports; and FIG. 6H illustrates cycling uphole, disengaging the open/close shifting tool dogs from the closed sleeve and pulling the BHA tool uphole out of hole (POOH) to another sleeve assembly;

FIG. 7Bi corresponds with FIG. 6B and illustrates the BHA in PTL mode to locate the selected sleeve;

FIG. 7Bii corresponds with FIG. 6B and illustrates the BHA in PTL mode with the dogs of the shifting located in the sleeve profile;

FIG. 7C corresponds with FIG. 6C and illustrates continued uphole movement of the BHA in the PTL mode, pulling the sleeve open;

FIGS. 7D and 7E is one drawing combining the steps of two drawings FIGS. 6D and 6E wherein the BHA is to run-in-hole below the sleeve assembly (in an intermediate RIHBe mode) and once below the sleeve assembly, then to fully set down to the SET/FRAC mode to actuate the packer seal to block the casing string downhole of the open sleeve assembly and then frac therethrough;

FIG. 7F corresponds with FIG. 6F and illustrates the BHA cycled to the PTR mode for re-locating the sleeve;

FIG. 7Gi corresponds with FIG. 6G and illustrates a partial setting down of the BHA in the SOFT SET/CLOSE mode to re-engage the BHA with the sleeve and in preparation to pump the BHA back downhole to close the sleeve assembly;

FIG. 7Gii also corresponds with a combined element of FIG. 6G and illustrates a pumping down of the BHA and engaged sleeve to close the sleeve assembly;

FIG. 7H corresponds with FIG. 6H and illustrates the BHA with constrained dogs pulled uphole in the POOH mode to the next sleeve assembly;

FIG. 8A illustrates the uphole J-Mechanism in RIH mode, and the slack sub between uphole the downhole J-Mechanisms retained in a collapsed position;

FIGS. 8Bi and 8Bii illustrate two stages of the PTL mode for locating and engaging the dogs with the profile in the sleeve;

FIG. 8C illustrate the last stage of the PTL mode, pulling uphole with sufficient force to shift the sleeve uphole to the open position, the slack sub being telescopically moved to the extended position for effective disconnect of the uphole and downhole J-Mechanisms;

FIG. 8Di illustrates the RIHBe mode for running-in-hole below the sleeve assembly with the dogs constrained for free movement, the slack sub shown in the extended position before being telescopically collapsed;

FIG. 8Dii illustrates the slack sub moving to the collapsed position to move the downhole J-Mechanism to cooperate with the uphole J-Mechanism, releasing the uphole J-Mechanism from the RIHBe mode;

FIG. 8E illustrates the shifting of the BHA to the SET/FRAC mode, the slack sub now in a collapsed position;

FIG. 8F illustrates the shifting of the BHA to the PTR relocate mode of the selected sleeve and engaging and setting the dogs again in the sleeve profile;

FIG. 8Gi illustrates the shifting of the BHA to SOFT SET/CLOSE mode for a partial setting of the packer of the BHA while still above the sleeve;

FIG. 8Gii illustrates fluid pressure is applied thereabove to the bore-restricting packer for assisting in forcibly shifting the BHA and engaged sleeve downhole; and FIG. 8H illustrates the BHA in pull-out-of-hole (POOH) mode for releasing the dogs and moving the BHA uphole to the next sleeve to be shifted;

DETAILED DESCRIPTION

Herein, embodiments of an improved bottomhole assembly (BHA) shifting tool 110 for shifting uphole-to-open closeable short sleeve assemblies (CSS) 160 are provided. Such a BHA 110 can be based on an improved version of Applicant's own prior art BHA as set forth in U.S. Pat. No. 10,472,928 published as US20170058644A1 on Mar. 2, 2017, the entirety of which is incorporated herein by reference. The shifting downhole-to-open, prior art J-Mechanism of the prior art BHA is improved to provide new shifting options which results in fewer overall cycles when used with the CSS assemblies 160.

Previous BHA and Sleeve

Figure 1A:
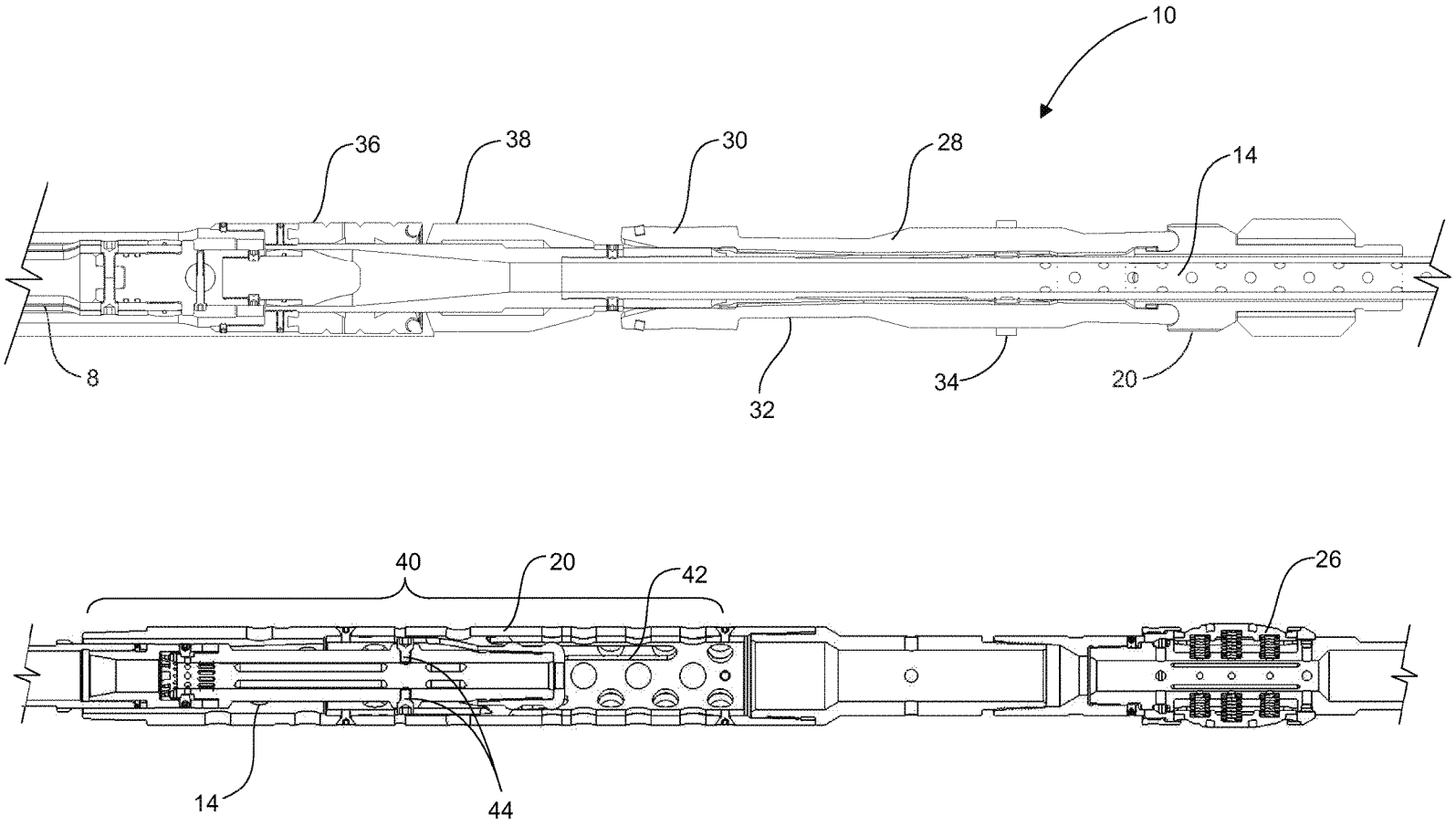
Fig. 1A PRIOR ART
FIG. 1A is a cross-sectional view of Applicant's prior art BHA incorporating a sleeve shifting tool, the modes for which are controlled by a J-slot mechanism.
Figure 1B:
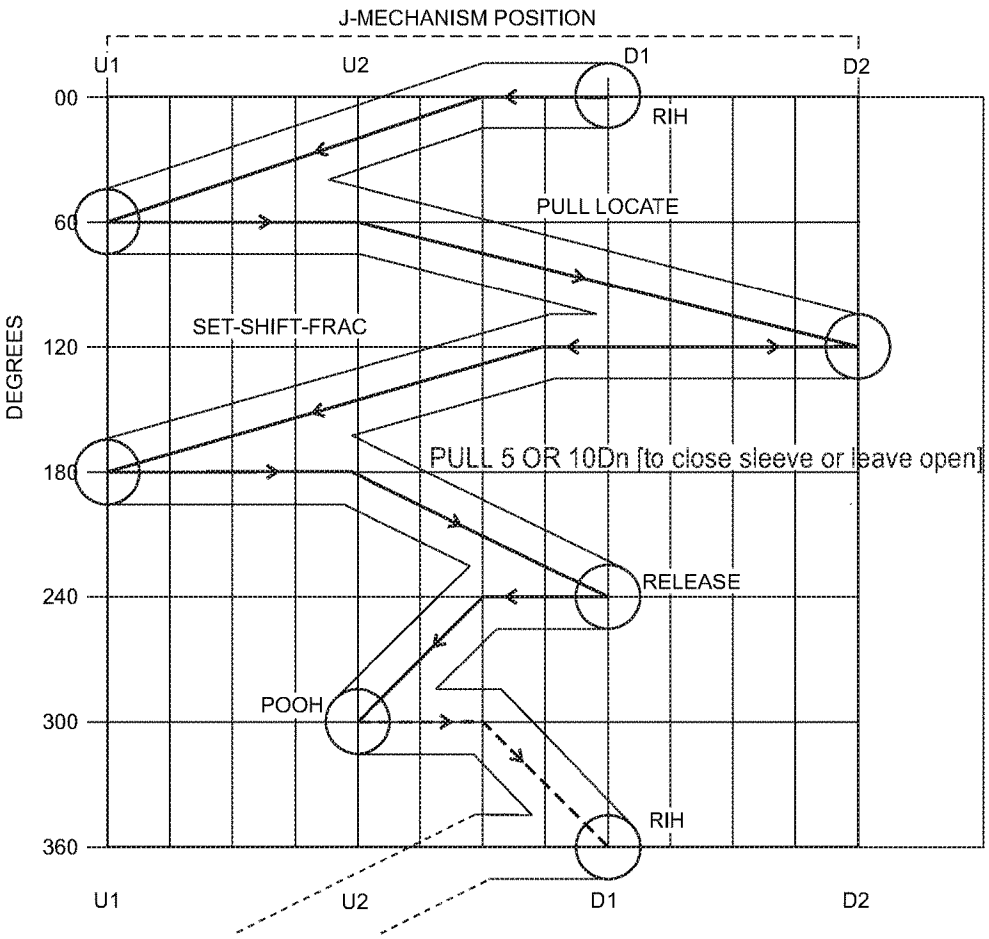
Fig. 1B PRIOR ART
FIG. 1B is a rolled out representation of a J-Profile implemented in the prior art BHA of FIG. 1A for an open downhole sleeve assembly, the J-Profile having modes including run-in-hole (RIH), pull-to-locate PTL, SET/OPEN/FRAC, PT-CLOSE or PT-Cycle, SOFT SET RELEASE to cycle the BHA down to release the cone from the dogs in preparation for moving uphole, and finally pull-out-of-hole (POOH) to relocate the BHA to the next sleeve.
Figure 1C:
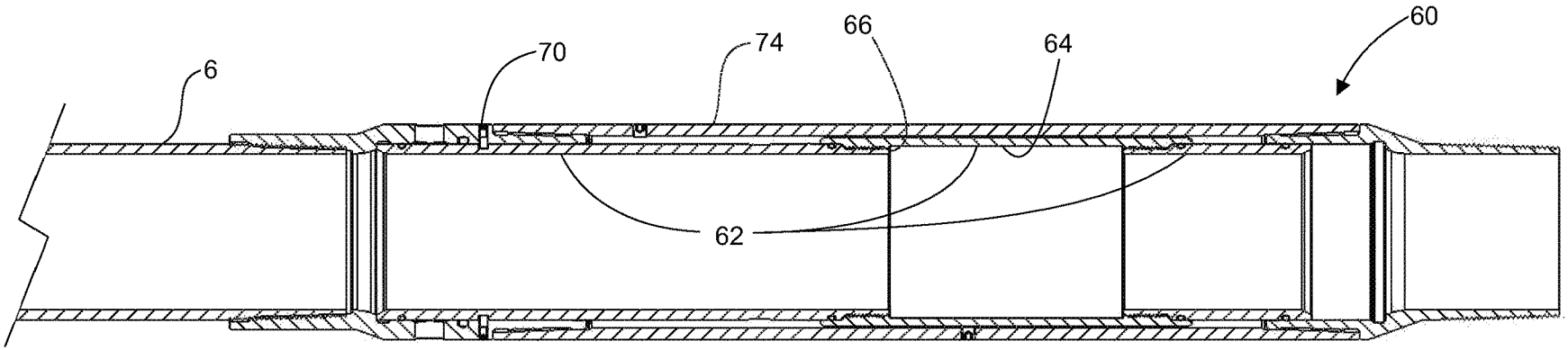
FIG. 1C is a cross-sectional view of a prior art, shift downhole-to-open sleeve valve in a closed position.
Figure 1D:
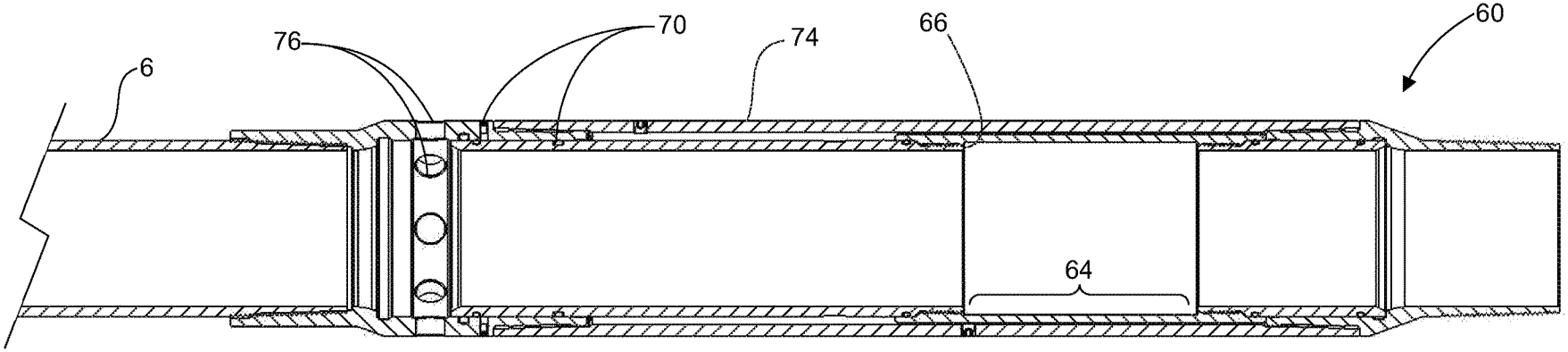
FIG. 1D is a cross-sectional view of the sleeve valve of FIG. 1C in the open position.
Figure 2:
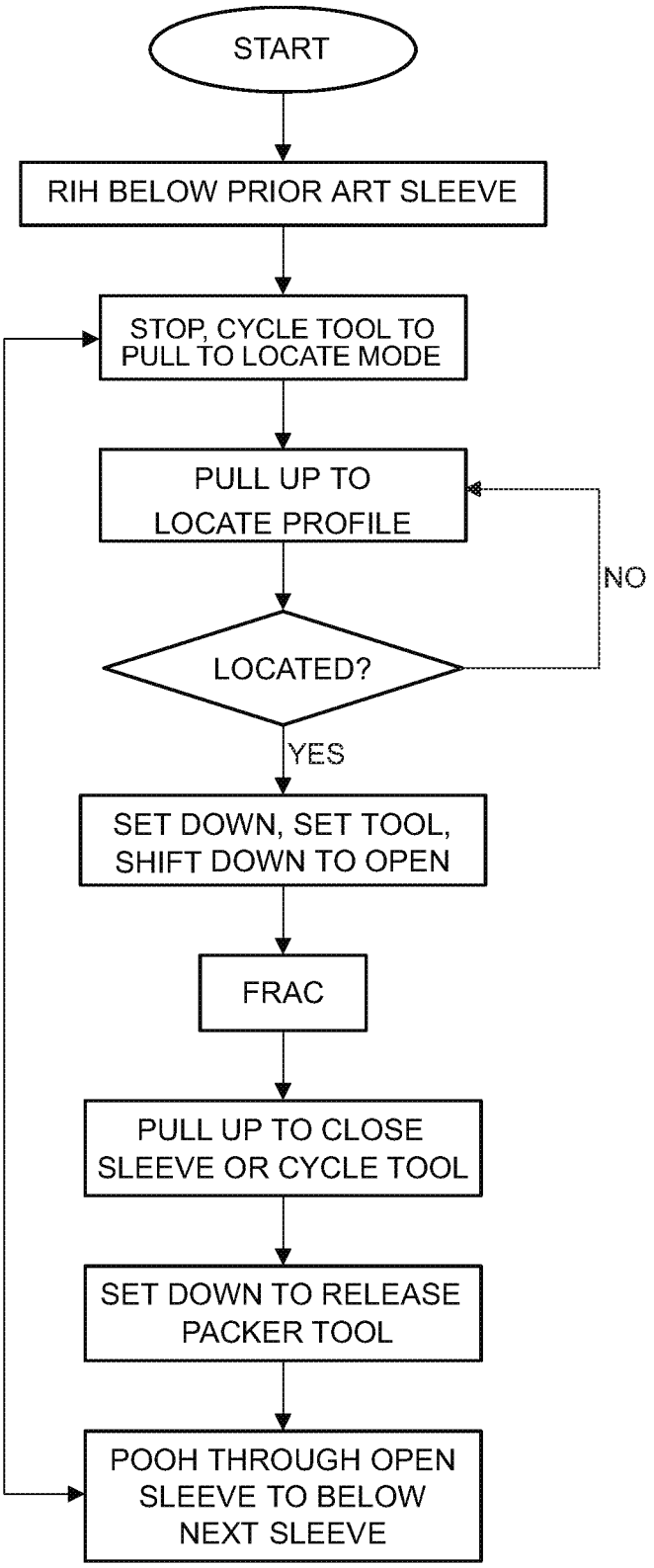
Fig. 2 PRIOR ART
FIG. 2 is a flowchart outlining the steps of shifting a prior art sleeve using the prior art shifting tool of FIG. 1A.

With reference to FIGS. 1A-2, Applicant's prior art BHA 10 implements a shifting tool for actuating a plurality of sleeve assemblies 60 located along a completion string 6 of a wellbore, such as a casing string. The wellbore can be a vertical, deviated, or horizontal wellbore. Each sleeve assembly 60 comprises a tubular sleeve 62, having a tool-engaging annular profile 64, slidably retained within a tubular sleeve housing 74. The sleeves 62 are actuable between an open position to expose and permit fluid communication through ports 76 of the sleeve housing 74, and a closed position to block ports 76 from fluid communication therethrough.

The BHA 10 is conveyed on a tubing string 8, such as coiled tubing (CT) or jointed tubulars, through the completion string 6. The BHA 10 can be used to sequentially engage with and manipulate a large number of sleeve assemblies 60 located along the casing string 6 between the open and closed positions thereof without tripping the BHA 10 from the wellbore.

The BHA 10 uses sleeve-engaging elements 30, such as dogs, located at ends of radially controllable, circumferentially spaced support arms 28 of the BHA 10 to engage the annular tool-engaging profile 64 of the sleeves 62.

The BHA 10 comprises a BHA mandrel 14 having a restraining means 34 axially fixed thereto, and a BHA housing 20 supporting the arms 28. The BHA mandrel 14 extends through the BHA housing 20 and is slidingly coupled therewith. The mandrel 14 is connected to the conveyance string 8, which can be axially manipulated to axially shift the mandrel 14 relative to the BHA housing 20.

The radially actuable arms 28 are pivotally supported on the BHA housing 20. In embodiments, the BHA housing 20 supports three or more circumferentially spaced, generally axially-extending arms 28 bearing dogs 30 at one end thereof. In embodiments, each arm 28 is pivotally connected at a ball and socket or base end thereof to the BHA housing 20, with the dogs 30 located at a dog end of the arm 28 opposite the base end. Each of the arms 28 have a varying radial upstanding height, thus defining a cam profile 32 configured to cooperate with the restraining means 34 of the BHA mandrel 14 to restrain the arms 28 in a radially inward position, or release the arms 28 to a radially outward position. The BHA mandrel 14 includes radial arm-biasing springs for biasing the arms 28 radially outward.

The restraining means 34 engaged with the cam profile 32 to control the radial positioning of the arms 28 and dogs 30 thereon to actuate the arms 28 between the radially inward and radially outward positions. The arms 28 and dogs 30 are actuated radially inward to overcome the radially outward biasing of the springs for run-into-hole (RIH) and pull-out-of-hole (POOH) movement of the BHA 10, and released radially outward for locating a sleeve 62 and engaging the tool-engaging profile 64 thereof. Manipulation of the BHA's arms 28 and dogs 30 is achieved using uphole and downhole movement of the BHA mandrel 14 relative to the BHA housing 20, which in turn varies the location of the restraining means 34 along the cam profile 32 of each of the arms 28.

The restraining means 34 can be a cam-encircling restraining ring axially fixed to the BHA mandrel 14. Alternatively, as disclosed in Applicant's pending U.S. application Ser. No. 16/162,740, the entirety of which is incorporated herein, the restraining means 34 for forcibly manipulating the radial position of the arms and supported dogs is a radially inward yoke or constrictor spider. The spider is again axially secured to the mandrel 14 and is driven uphole and downhole together with the mandrel 14.

Further, the BHA has a cone 38 for positively locking the dogs 30 in the radially outwards position, for example locking the dogs 30 the sleeve profile 64 for opening and closing of the sleeve 62. Sealing elements 36, such as packers, can be located on the mandrel 14 for engaging and sealing with the sleeves 62 to block fluid flow through the annulus between the BHA 10 and the completion string 6. The mandrel 14 can be tubular for selectable fluid communication therethrough: for example, blocked when performing treatment operations; and open when moving the tool.

The BHA housing 20 is connected to at least one drag block 26 or other movement-resisting element for restraining movement of the housing 20 in the casing string 6, and aiding in relative movement between the mandrel 14 and housing 20 and thereby shifting of a J-Mechanism 40 of the BHA, described in further detail below. The BHA housing 20 is movable in the casing string 6 by overcoming the frictional forces between the drag block 26 and casing string 6. The drag block 26 can include a repurposed casing collar locator acting as a drag block 26, or a stacked beam drag block, as introduced by Applicant in published application US20160245029A1 published Aug. 25, 2016, incorporated herein by reference in its entirety.

The axial position of the BHA mandrel 14 relative to the BHA housing 20 is controlled by an axially indexing J-Mechanism 40 housed in the BHA housing 20. For example, the J-Mechanism 40 can be a mechanical design configured to be operable with a shifting member 44, such as a J-Pin, of the BHA mandrel 14. The J-Pin 44 is coupled with a J-Profile 42 of the J-Mechanism 40. Axial reciprocation of the mandrel 14 cycles the J-Pin 44 through various axial positions defined by the J-Profile 42. The engagement of the J-Pin 44 with the J-Profile 42 enables controlled axial manipulation of the axial position of the BHA mandrel 14 relative to the BHA housing 20, and thereby the axial positioning of the restraining means 34 relative to the arms 28. The movement of the restraining means 34 along the cam profile 32 of the arms 28 actuates the arms 28 between the radially inward and radially outward positions. The J-Profile 32 of the J-Mechanism 40 delineates a number of axial positions of the BHA mandrel 14 relative to the BHA housing 20. The BHA 10 can be cycled through the various positions of the J-Profile 42 by shifting the BHA mandrel 14 uphole and downhole, the positions corresponding with axial positions of the restraining means 34 of the BHA mandrel 14 relative to the cam profiles 32 of the arms 28 to actuate the arms 28 between the radially inward constricted/collapsed position and the radially outward engagement position.

The sequencing of the positions of the J-Profile 42 may be selected at surface before running-in-hole. The J-Profile 42 can be changed by substitution of the J-Mechanism 40 with a J-Mechanism 40 with the desired J-Profile 42.

As discussed above, axial and specific alignment of the BHA mandrel 14 relative to the BHA housing 20 and cams 32 on the dog-supporting arms 28 at least selectively restrains or constrains the radial position of the dogs 30 for enabling engagement and disengagement with a sleeve 62. With reference to FIG. 1B, the J-Mechanism 40 delineates at least four distinct axial positions D1, D2, U1, U2 corresponding to four modes of the BHA 10: 1) a RIH mode, as shown in FIG. 1A, wherein the J-Pin 44 is at an intermediate downhole position D1 in which the restraining means 34 restrains the arms 28 and dogs 30 in the radially inward position for running-in-hole of the BHA, 2) a pull-to-locate (PTL) mode wherein the J-Pin 44 is at an extreme uphole position U1 in which the restraining means 34 frees the arms 28 and dogs 30 to be biased to the radially outwardly position such that they may be dragged along the inside wall of the completion string 6 to locate the profile 64 of a sleeve 62, 3) a SET-SHIFT-FRAC mode wherein the J-Pin 44 is at an extreme downhole position D2 in which the cone 38 is driven into engagement with the arms 28 such that the dogs 30 are positively locked in the sleeve profile 64 of the located sleeve 62 for uphole and/or downhole actuation thereof, and the packers 36 are compressed to seal the annulus for fracturing operations, 4) a pull-to-release or CLOSE mode wherein the J-Pin 44 is at the extreme uphole position U1, in which the arms 28 and dogs 30 are again engaged with the sleeve profile 64 and the BHA 10 can be pulled uphole with sufficient force to close the sleeve 62 or the sleeve 62 can be left open, 5) a soft-set RELEASE mode wherein the J-Pin 44 is at the intermediate downhole position D1 such that the restraining means 34 restrains the arms 28 and dogs 40 in the radially inwards position, and 6) a POOH mode wherein the J-Pin 44 is at an intermediate uphole position D2 in which the restraining means 34 continues to restrain the arms 28 and dogs 30 in the radially inwards position to permit the BHA 10 to be pulled uphole to a subsequent sleeve. The cycling between the various modes allows the BHA 10 to engage with a selected sleeve 62 to shift it to the open or closed positions and prepare the wellbore for fracturing, yet also be releasable for longitudinal or axial movement of the BHA 10 to the next sleeve valve 60.

The BHA 10 is configured to use the dogs 30 to locate sleeves 62, thus eliminating the need for an independent location device such as a collar or sleeve end locator. An uphole shoulder of the dog 30 is used to locate an upper shoulder 66 of the sleeve profile for location purposes, and for optional release, shifting uphole for re-closing, or both. When the BHA 10 is used with Applicant's prior art sleeve assemblies 60, there is no need to compromise the locator function of the dogs 30 by requiring additional structure to distinguish between the sleeve profile, sleeve ends, or casing collars, as is performed in conventional tools.

Closeable Sleeve Assembly

Figure 3:
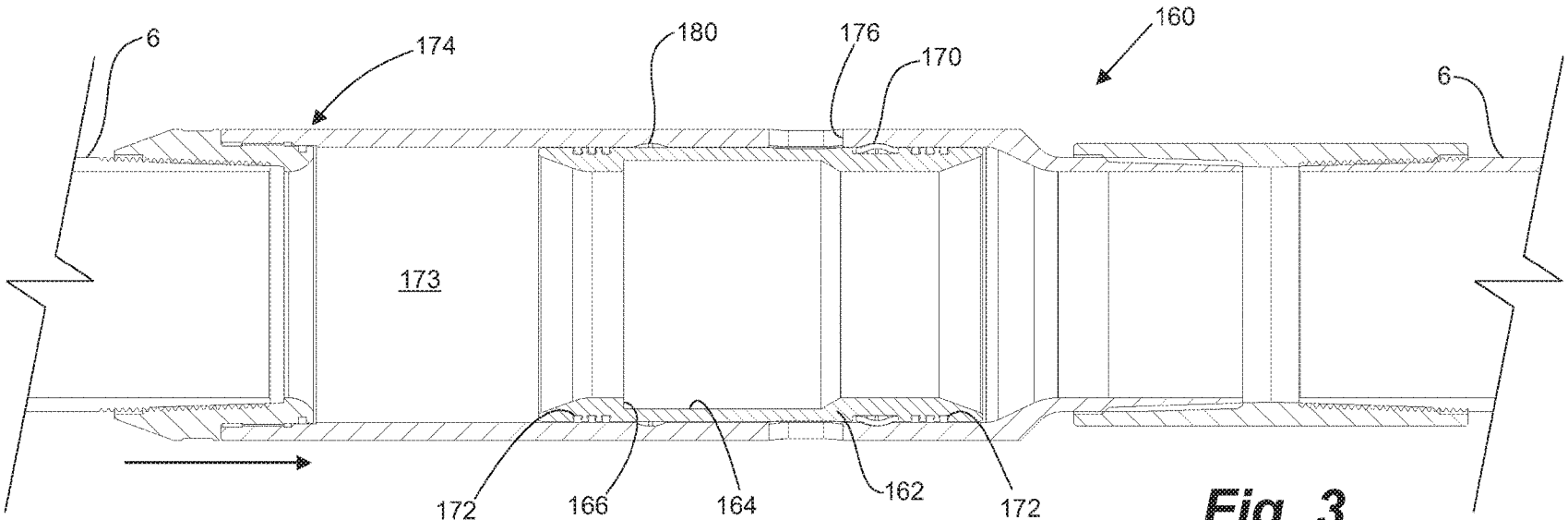
FIG. 3 is a cross-sectional view of an embodiment of a closeable sleeve assembly that can be both opened and closed, the sliding sleeve of which is shown in a downhole closed position, blocking fluid flow through a plurality of ports formed in a tubular housing of the sleeve assembly.
Figure 4:
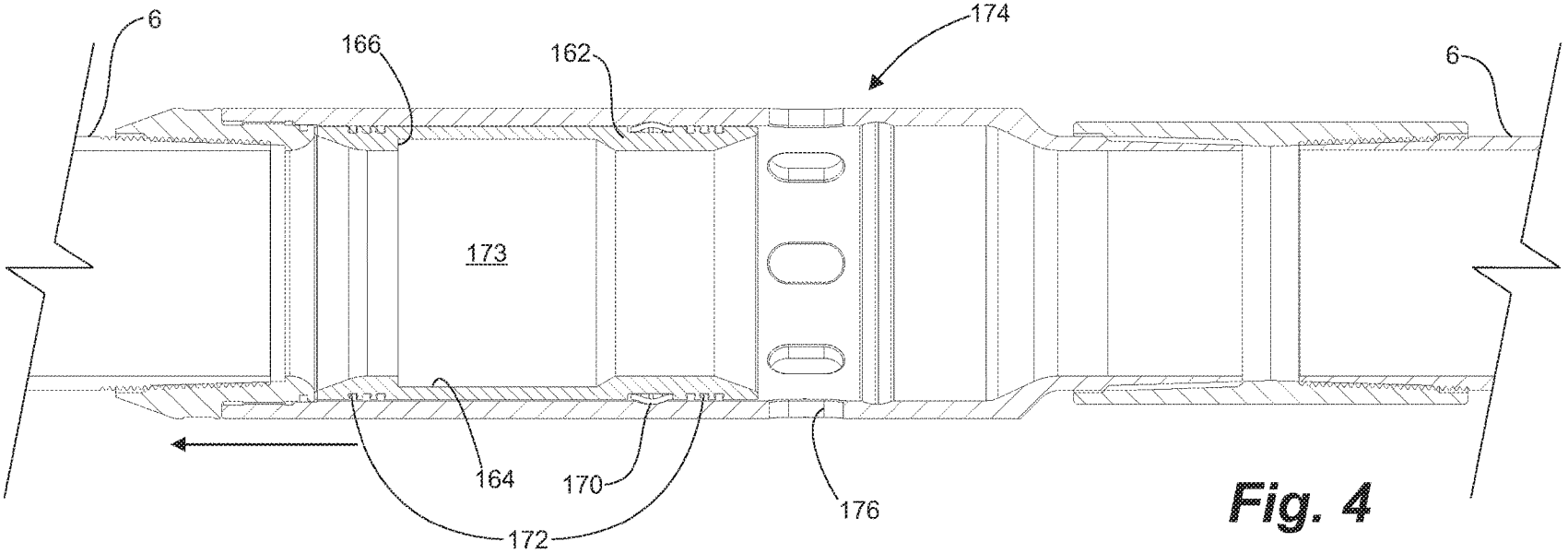
FIG. 4 is a cross-section view of the closeable sleeve assembly, according to FIG. 3, the sliding sleeve shown axially displaced uphole in the open position for unblocking flow of fluids through the plurality of ports.

Having reference to FIGS. 3, and 4, embodiments taught herein comprise an uphole-to-open closeable short sleeve (CSS) assembly 160 incorporated into a casing string 6. The sleeve assembly 160 is short in length, incorporating only an annular tool-engagement profile 164 therealong, but need not include any additional length for accommodating sealing elements or anchors therein. Thus the sleeve assemblies 160 can be very short. The tool-engagement profile 164 renders the sleeve 162 closeable when used in combination with the improved BHA 110 disclosed herein. This CSS sleeve assembly 160 can be actuated at least once between open and closed positions, and can also be actuated repeatedly therebetween.

The sleeve assembly 160 has a tubular, closeable sleeve 162 that is retained and axially shiftable within a bore 173 of a tubular sleeve housing 174 between open and closed positions. In embodiments, the sleeve 162 is shifted from an initial closed position (FIG. 3), blocking flow of one or more ports 176 of the sleeve housing 174, to an open position (FIG. 4) to permit flow of fluids through the one or more ports 176, such as during treatment including hydraulic fracturing (fracing). The tubular housing 174 is incorporated into a tubular string in the wellbore, typically a completion or casing string 6.

Figures 6A, 6B, 6C, 6D, 6E:
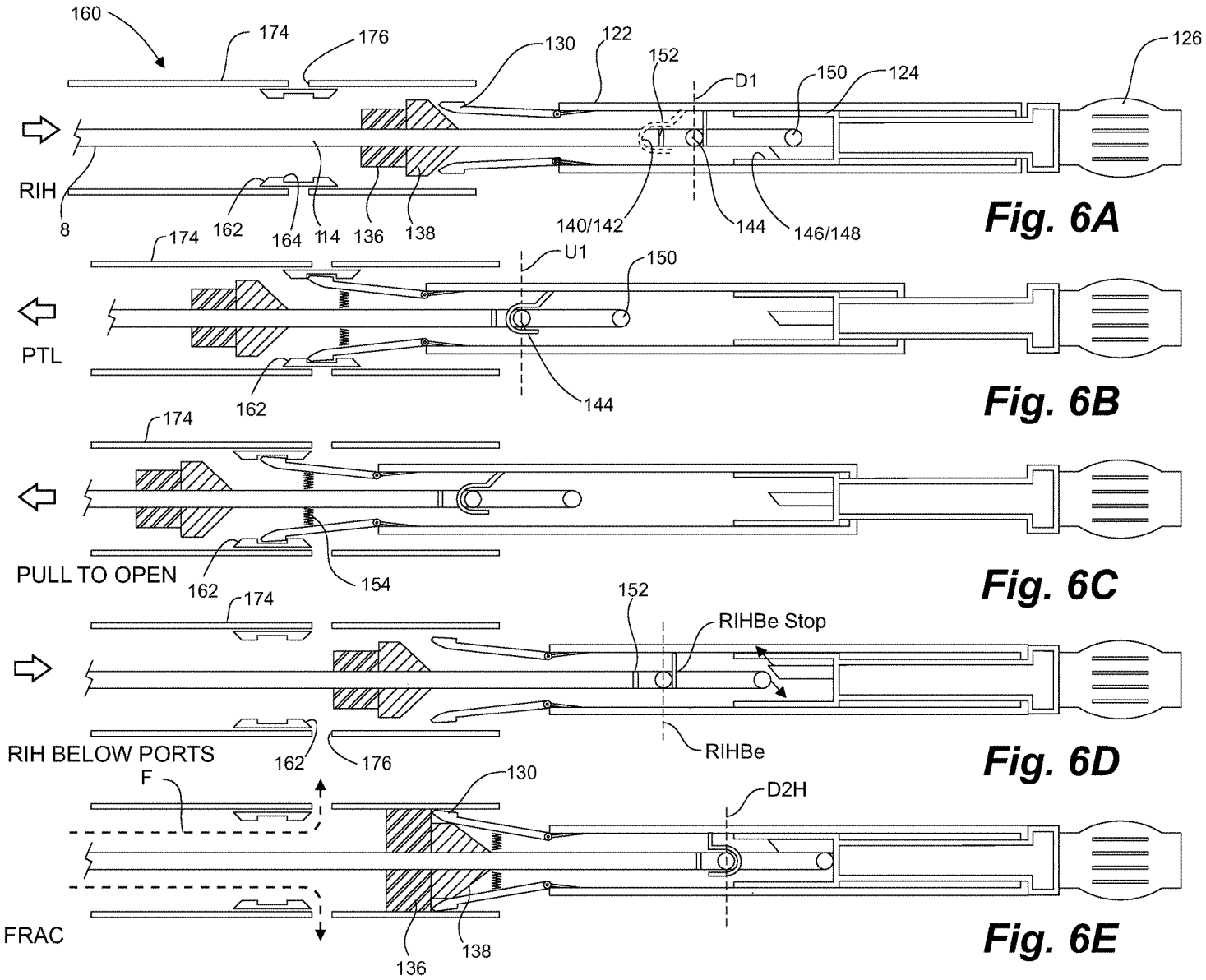
FIGS. 6A to 6H each illustrate a schematic cross-sectional view of the closeable sleeve assembly of FIGS. 3 and 4 and each figure illustrates a separate step in a sequence of the steps for opening and closing ports. The BHA is shown left to right from the uphole conveyance string down to the downhole drag beam end. The BHA has a two-stage J-Mechanism fit thereto, an uphole J-Profile having modes including RIH, PTL/OPEN, RIH Below Sleeve, SET/FRAC, pull-to-relocate (PTR), SOFT SET/CLOSE, and POOH, the RIH Below Sleeve mode combining the uphole J-Mechanism with a downhole J-Mechanism to delay the setting of a packer of the BHA until the BHA is located below the sleeve assembly. More particularly.
Figures 6F, 6G, 6H:
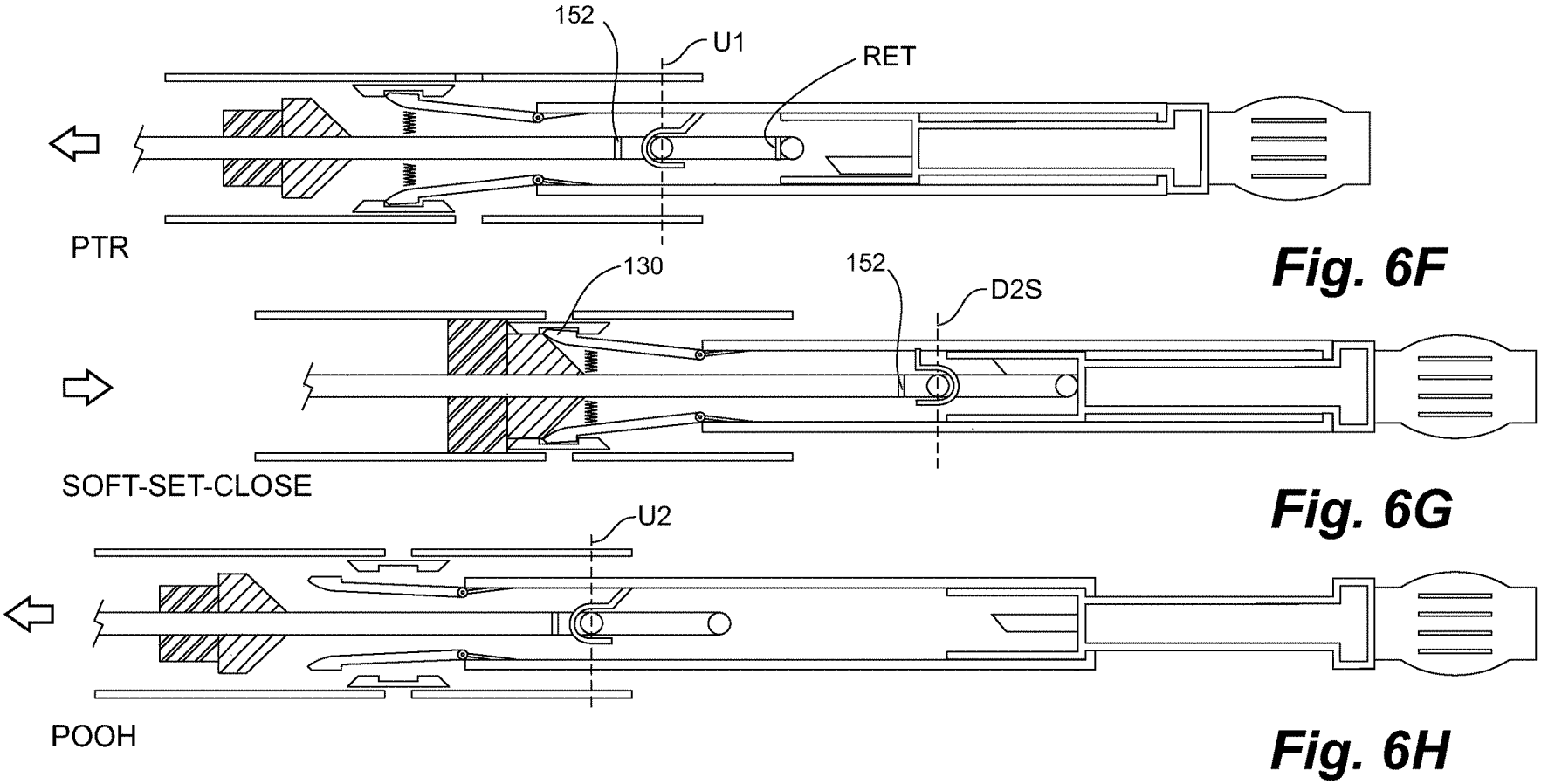

The sleeve 162 has an annular profile 164 formed in an inner surface of the sleeve 162 intermediate the ends thereof. The profile 164 comprises a downhole facing, upper shoulder 166, which is configured to be engaged by a shifting tool 110 for positive locating of the sleeve 162. In embodiments, the upper shoulder 166 is a generally right-angle interface. Pulling uphole on the shifting tool 110 when engaged with the shoulder 166 causes the sleeve 162 to shift uphole. In embodiments, shifting the sleeve 162 uphole opens the ports 176 of the housing 174. In embodiments, a downhole interface 168 of the profile 164 can be an acute angle to reduce the likelihood of accidental engagement of a tool with the profile 64 as it travels downhole. As shown in FIGS. 6G and 7G, the cone-and-dog engagement ensures the dogs 130 can shift the sleeve 162 without disengaging from the profile 164.

Initially, a first retainer or detent 170 retains the sleeve 162 in the downhole closed position, the detent 170 being forcibly overcome by the pulling force exerted on the shifting tool via the tubing string 8. Once the holding force of the detent 170 has been overcome, the sleeve 162 can slide uphole. In embodiments, an annular groove 180 can be formed in the inner wall of the sleeve housing 174 to receive the detent 170 and secure the sleeve 162 in the open position, such that the holding force of the detent 170 must be overcome to shift the sleeve 162 downhole to the closed position. In embodiments, the sleeve 162 can be held in the open position using a second retainer (not shown) such as another detent, or grapple lock, snap ring or the like, acting between the sleeve 162 and the housing 174 adjacent the uphole end thereof. The holding force of the second retainer would need to be overcome when the sleeve 162 is shifted to the downhole, closed position. In embodiments, the detent 170 can be engaged with a second annular groove when the sleeve 162 is in the close position, such that the holding force of the detent 170 in the second annular groove must be overcome in order to shift the sleeve 162 to the uphole open position.

The sleeve 162 comprises two or more sets of O-ring seals 172,172 spaced axially apart and fit to the annular interface 178 between the sleeve 162 and the housing 174. The O-rings 172,172 are spaced apart on an outer surface of the sleeve 162 with a least one O-ring seal 172 uphole of the one or more ports 176 and at least one O-ring seal 172 downhole of the one or more ports 176 when the sleeve 162 is in the closed position. The O-ring seals 172,172 seal fluid from travelling along the interface 178 to the ports 176 when the sleeve 162 is in the closed position.

In FIG. 4, the BHA 110 is operated to engage the profile 164 of the sleeve 162 to exert an uphole pulling force thereon, causing the sleeve 162 to shift uphole for exposing and opening the plurality of ports 176.

Open/Close Shifting Tool for Closeable Sleeve

As shown in FIGS. 7 and 8, embodiments of an improved BHA 110 for actuating the sleeves 162 of CSS sleeve assemblies 160 incorporate elements of Applicant's prior art single-shift shifting tool, as described in US20170058644A and as summarized above.

Generally, the embodiments of the improved BHA 110 differ from the prior art shifting tool 10 with respect to improvements to components and methods of operation thereof for enabling an uphole opening of the CSS sleeve assembly 160 and positioning sealing elements 136 the BHA 110 downhole of the sleeve assembly 160 after opening the sleeve 162 for sealing the wellbore and fracturing there-above. The BHA 110 is also capable of re-locating the sleeve 162 and shifting the sleeve 162 downhole to the closed position after zone treatment through the sleeve assembly 160 has been completed.

The BHA 110 comprises a BHA mandrel 114 and a two-part BHA housing/slack sub 120 having a first housing portion 122 telescopingly connected with a second housing portion 124. The BHA housing 120 incorporates a dual J-Mechanism comprising a first J-Mechanism 140 housed in the first housing portion 122 and a second J-Mechanism 146 housed in the second housing portion 124, the J-Mechanisms 140,146 cooperating to delineate various operating modes of the BHA 110. The first J-mechanism 140 defines the various positions of the mandrel 114 relative to the first housing portion 122, and the second J-Mechanism 146 defines the various positions of the first housing portion 122 relative to the second housing portion 124.

Figure 13:
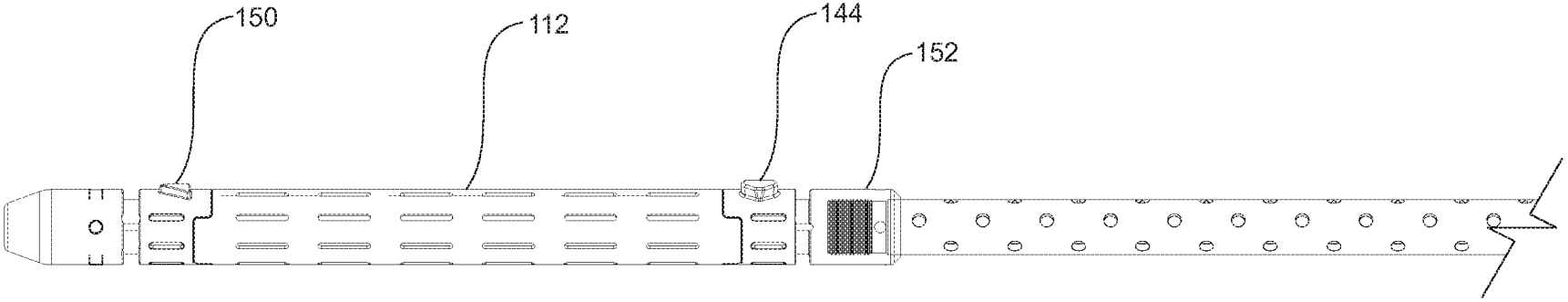
FIG. 13 is a side elevation view of a mandrel of an embodiment of a BHA having first and second J-Pins.

With reference to FIG. 13, the BHA mandrel 114 has a first J-Pin 144 for cooperating with the first J-Mechanism 140 and following a first J-Profile 142 thereof, and a second J-Pin 150 for cooperating with the second J-Mechanism 146 and following a second J-Profile 148 thereof. The J-pins 144,150 can be spaced a fixed axial distance from one another on the mandrel 114. In the depicted embodiments, the first housing portion 122 is located uphole of the second housing portion 124. The first housing portion 122 and second housing portion 124 together form the slidably telescopic slack sub 120 that enables operatively coupling an decoupling the second J-Mechanism 146 from the first J-Mechanism 140. As shown in FIG. 6A, the second housing portion 124 is slidable within the bore of the first housing portion 120. In an axially collapsed position, one housing fits substantially within the bore of the other. The BHA housing portions 120,122 can be extended to an axially collapsed position to an axially extended position by an uphole pulling action on the conveyance string 8. As described in greater detail below, the J-Profiles 142,148 can be configured to retain the BHA housing portions 120,122 in the collapsed position in some operational modes, and to permit the housing portions 120,122 to be actuated to the extended or collapsed positions in other modes.

To aid in positioning the packer 136 of the BHA 110 below the ports 176 of the sleeve assembly 160 after the BHA 110 has shifted the sleeve 162 to the open position, a stroke length of the slack sub 120, that is, the axial distance travelled by the first housing 122 from the axially extended position to the collapsed position and vice versa, can be selected to be greater than an axial distance between the packer 136 and the ports 176 of the sleeve housing 174 immediately after the sleeve 162 has been shifted to the open position.

In the embodiments depicted in FIGS. 6A-8H, the housings 122,124 are rotationally locked, while remaining slidably and telescopically coupled, while the J-Pins 144,150 are both rotatable about the mandrel 114 and rotationally locked with each other, so as to ensure proper indexing of the uphole and downhole J-Profiles 228,230. For example, in the depicted embodiments, a downhole portion of the BHA mandrel 114*b*, supporting the first and second J-Pins 144,150, is mounted by a rotational bearing 152 to an uphole portion of the BHA mandrel 114 so as to permit the J-Pins 144,150 to move circumferentially along their respective J-Profiles 142,148. The BHA housings 122,124 supporting the J-Profiles 142,148 are less capable of rotating in the casing string 6 due to the proximity to the wall of the casing string 6 and coupling with the drag block 126, which restricts rotational motion thereof.

In other embodiments, the first and second J-Profiles 142,148 can be located on the BHA mandrel 114 and the first and second J-Pins 144,150 can extend radially inward from the first and second housings 122,124, respectively, to engage with the J-Profiles.

Similar to Applicant's prior art BHA 10 as described above, the first housing portion 122 supports circumferentially spaced shifting arms 128 having sleeve-engaging members or dogs 130 located at an uphole end thereof. Springs 154 can bias the arms 128 and dogs 130 to the radially outward position. The second housing portion 124 is connected to a drag block 126 such that it is frictionally restrained in the casing string 6.

The BHA mandrel 114 is fit with one or more sealing elements such as a packer 136. A cone 138 is also located on the mandrel 114 for positively engaging the arms 128 and dogs 130 in the radially outward position for locking the dogs 130 in engagement with the sleeve profile 164. As described in further detail below, the cone 138 can also be driven into the arms 128 to engage the dogs 130 with the casing string 6 for arresting movement of the first housing portion 122 in the casing string 6. The cone 138 can be elongated axially compared to conventional BHAs so as to provide intermediate running positions, including the capability to RIH the BHA 110 to position the packer 136 below the sleeve assembly 160 after opening the sleeve 162, and to provide a partially actuated position of the packer 136 when compressing the packer 136 thereabove such that fluid pressure in the annulus between the tubing string 8 and casing string 6 can be used to shift the sleeve 162 downhole to the close position, as described below. In one aspect, the elongated cone 138 spaces the dogs 130 further downhole from the packer 136 relative to conventional BHAs and likewise, to space the packer 136 further uphole from the dogs 130 uphole of the sleeve 162 during shifting operations.

Actuation of the BHA 110 through its various operational modes, as delineated by the first and second J-Mechanisms 140,146, is effected through axial manipulation via the conveyance string 8. Axial reciprocation of the conveyance string 8 cycles the BHA 110 through the operational modes defined by the J-Mechanisms 140,146 and actuate the axial position of the mandrel 114 relative to the first housing 122 to control the radial position of the arms 128 and dogs 130 and to lock/unlock the arms 128 and dogs 130 using the cone 138, as well as actuate the axial position of the first housing portion 122 relative to the second housing portion 124 and drag block 124.

The first J-Mechanism 140 is fit to the first housing portion 122 and its first J-Profile 142 has a fixed spacing relative to the arms 128 and dogs 130 of the first housing portion 122. The second J-Mechanism 146 is fit to the second housing portion 124 and engages the second J-Pin 150 to permit the uphole J-Pin 144 to cycle to an extreme downhole position, and to lock the housing portions 122,124 in an axially collapsed position during the sequence of steps defined by the J-Profiles 142,148 for closing the sleeve, described in greater detail below.

Figures 8A, 8B, 8C, 8D, 8E, 8F, 8G, 8H:
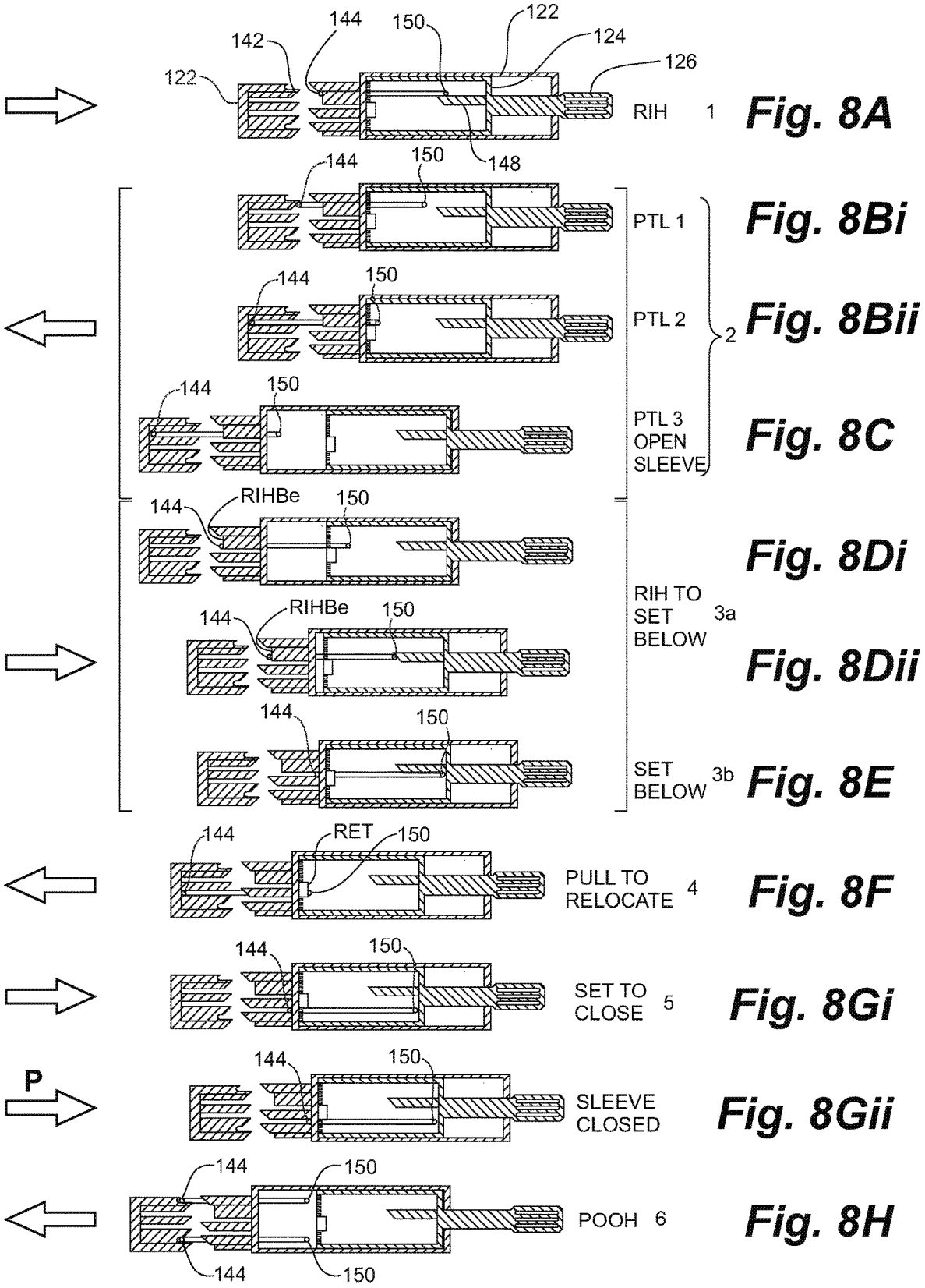
FIGS. 8A to 8H correspond to files FIGS. 6A to 6H and illustrate a schematic representation of the J-Profiles of the uphole and downhole J-Mechanisms working in cooperation, and more particularly.
Figure 9:
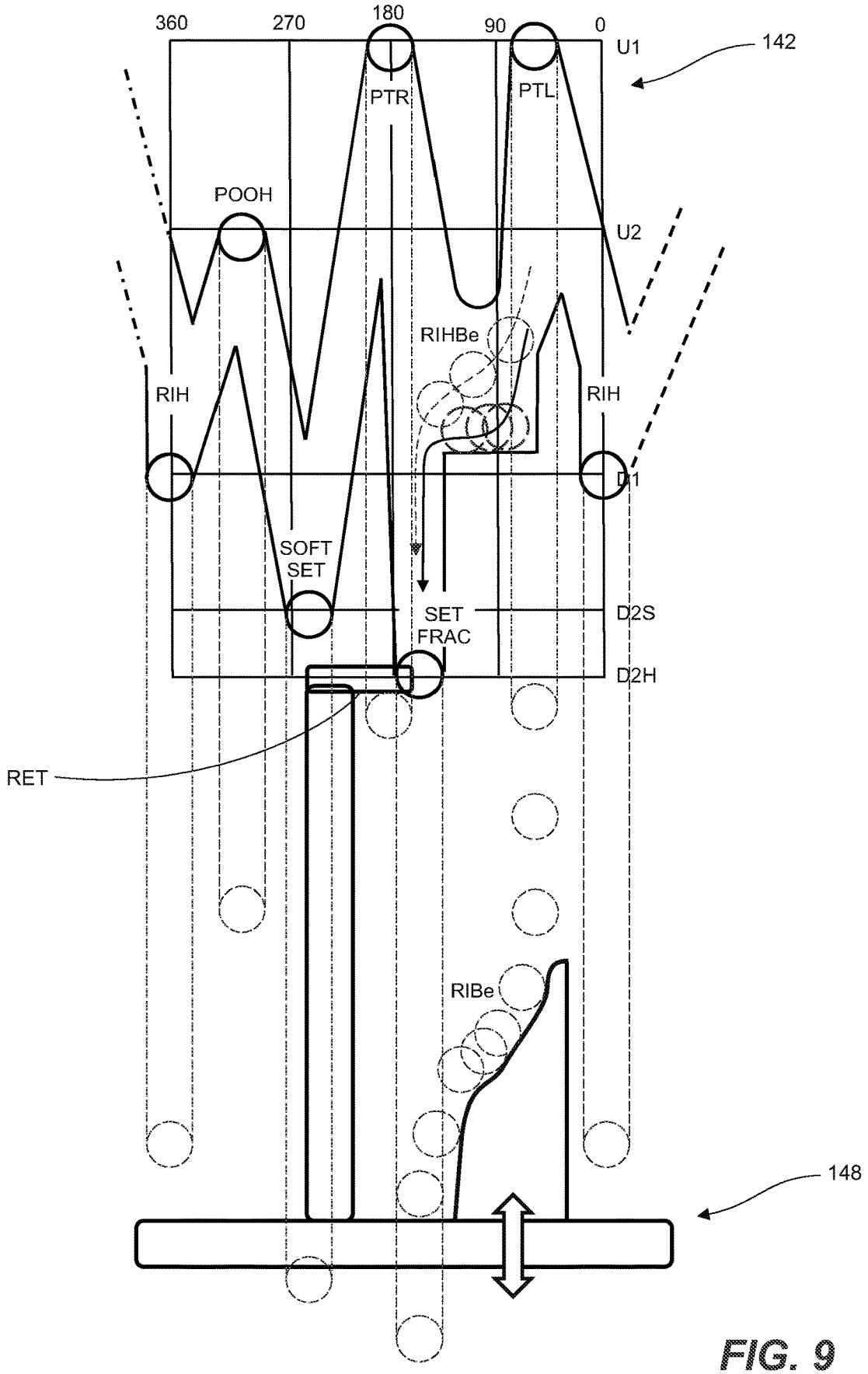
FIG. 9 is a full revolution rollout representation of the uphole J-Mechanism and of the downhole J-Mechanism when placed axially in cooperation with the uphole J-Mechanism.

With reference to FIGS. 8A to 9, in an embodiment, the J-Profiles 142,148 cooperate to define six operational modes: 1) run-in-hole (RIH), 2) pull-to-locate (PTL), 3) SET-FRAC, 4) pull-to-relocate (PTR), 5) SOFT-SET-CLOSE, 6) pull-out-of-hole (POOH), as well as an intermediate RIHBe mode between the PTL and SET-FRAC modes, enabled by the slack sub 120, which are described in further detail below.

Method of Shifting Embodiments of the Sleeve

Having reference to FIGS. 6A to 6H, the dual J-Mechanism sequences for shifting the closeable sleeve 112 for both opening and closing ports 118 are illustrated. The J-Profiles 142,148 in the uphole and downhole BHA housings 122,124 are shown as indexing circumferentially merely for illustrative purposes so that the reader can more easily distinguish the various positions of the J-Pins 144,150 in the J-Profiles 142,148 on the 2-dimensional representation, which correspond to the various modes of the BHA 110. In actual use, for this embodiment, it is the J-Pins 144,150 that rotate about the BHA mandrel 114 in the rotationally restrained housing portions 122,124 due to the bearing 152.

Figure 5:
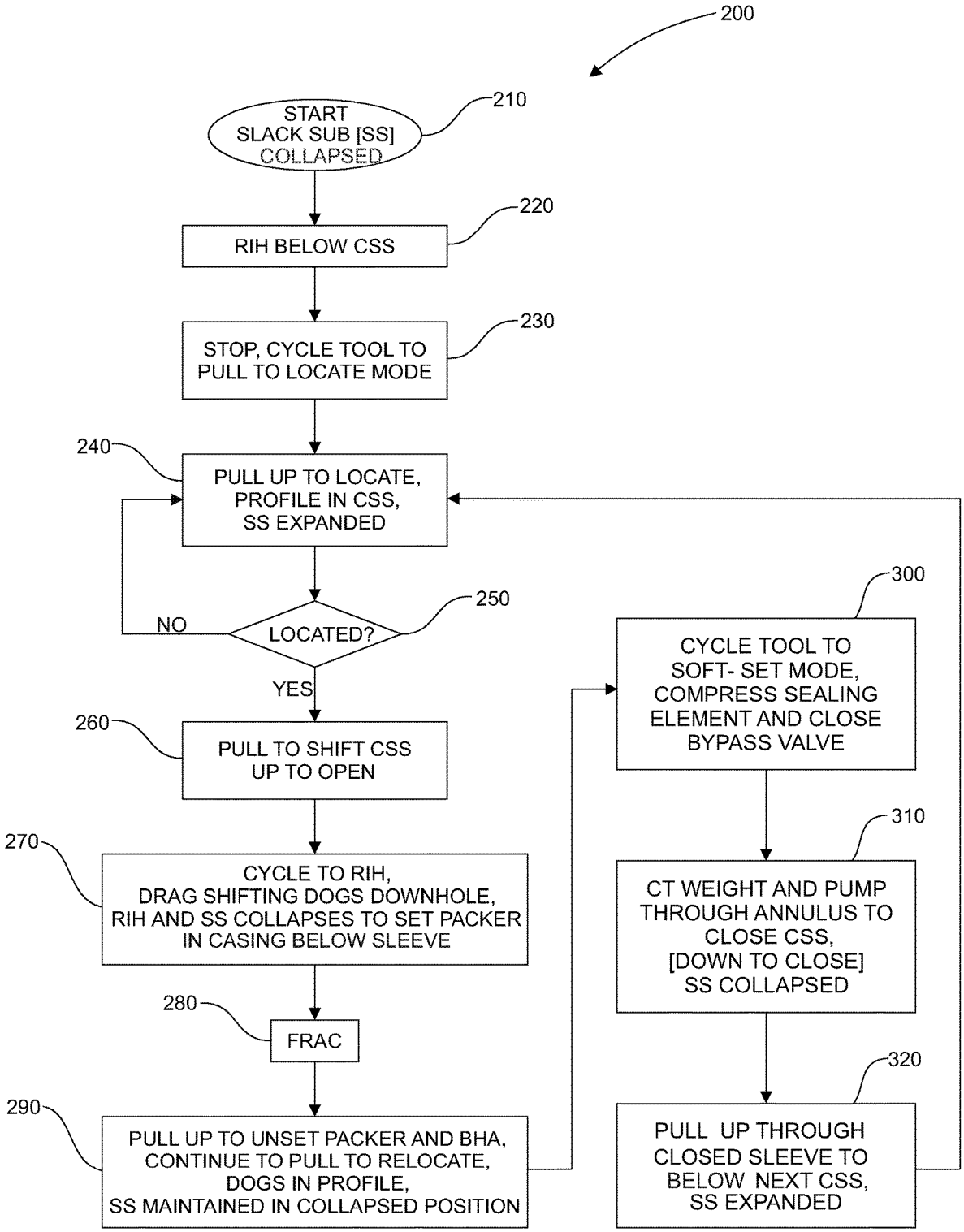
FIG. 5 is flow chart outlining the steps of opening a closeable sleeve and the additional steps for closing the closeable sleeve.

FIG. 5 depicts an exemplary process for operating the BHA 110 to open a CSS sleeve 162 for fracturing operations, and closing the sleeve 162 after fracturing is completed.

FIGS. 7A to 7H are side cross-sectional views of the entirely of the BHA 110 extending through a portion of a casing string 6 having a sleeve assembly 160 fit therein. While the scale is small, the relative location of the packer 136, dogs 130, first BHA housing portion 122 and first J-Profile 142, and second BHA housing portion 124 and second J-Profile 148. The figures illustrate the components and their relationship radially and axially with the sleeve assembly 110.

FIGS. 8A to 8H are circumferentially rolled-out illustrations of the first and second BHA housing portions 122,124 and their respective J-Profiles 142,148. The housing portions 122,124 are illustrated in their various telescoping configurations depending on the modes described above. This schematic representation is provided as an alternative visualization of the dual J-Mechanism sequences for shifting the sleeve 162 for both opening and closing ports 176. The housing portions 122,124 are slidable with respect to each other, but are rotationally fixed to ensure alignment of the first and second J-Profiles 142,148 for proper indexing of the J-Pins 144,150. The movement of the first and second J-Pins 144,150 is shown cycling through the various positions of the respective first and second J-Profiles 142,148. For simplification, the BHA mandrel 114 uphole of the J-Pins 144,150 is omitted, and only the J-Pins 144,150 are shown.

Figure 10A:
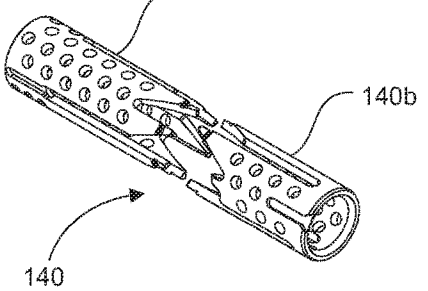
FIG. 10A is a perspective view of a uphole J-Mechanism of an embodiment of a BHA.
Figure 10B:
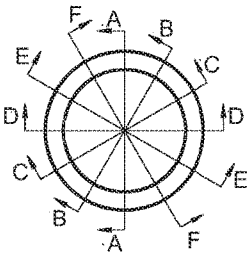
FIG. 10B is an axial elevation view of a first portion of the uphole J-Mechanism of FIG. 10A.
Figure 10C:
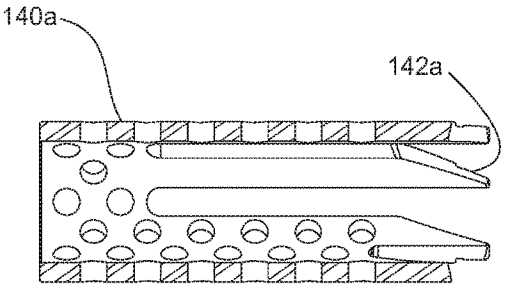
FIG. 10C to 10H are side cross-sectional elevation views of the first portion of the uphole J-Mechanism according to the cut lines of FIG. 10B.
Figure 10D:
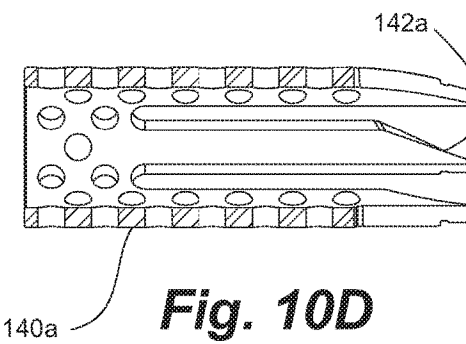
Figure 10E:
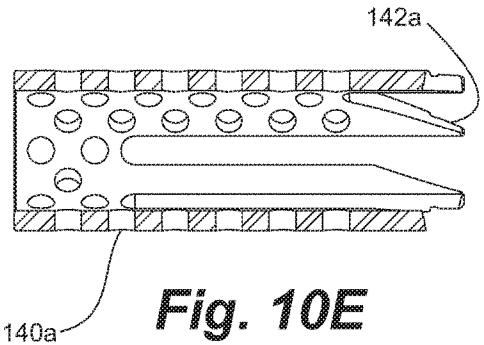
Figure 10F:
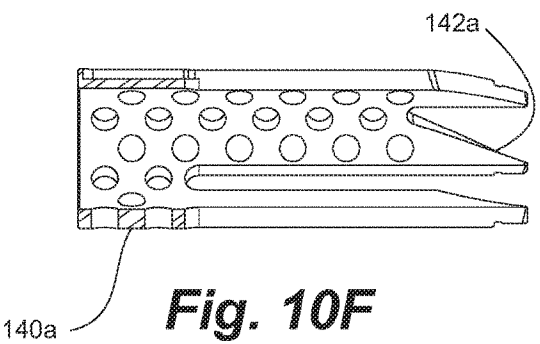
Figure 10G:
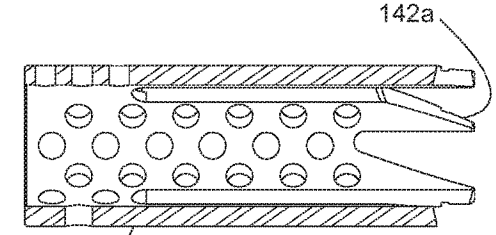
Figure 10H:
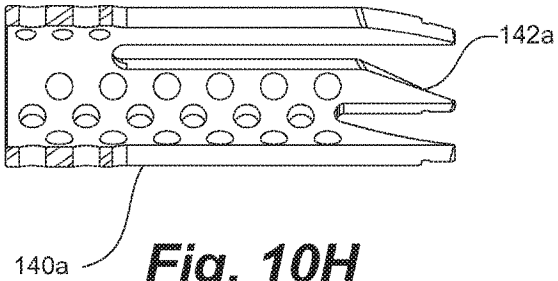
Figure 11A:
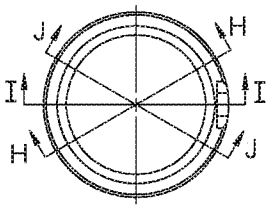
FIG. 11A is an axial elevation view of a second portion of the uphole J-Mechanism of FIG. 10A.
Figure 11C:
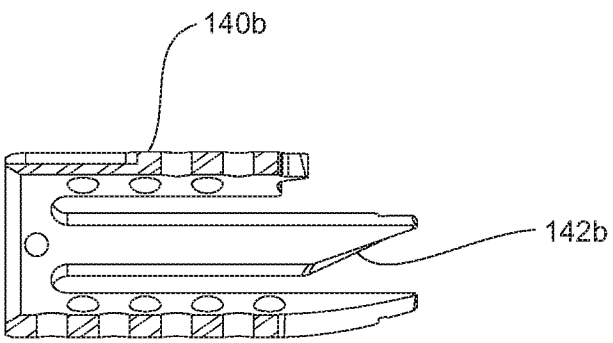
FIG. 11B to 11D are side cross-sectional elevation views of the second portion of the uphole J-Mechanism according to the cut lines of FIG. 11A.
Figure 11B:
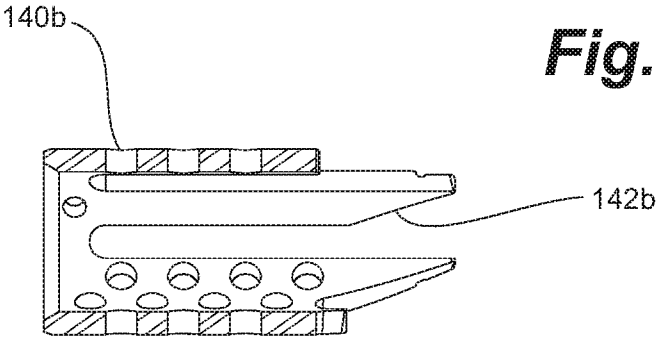
Figure 11D:
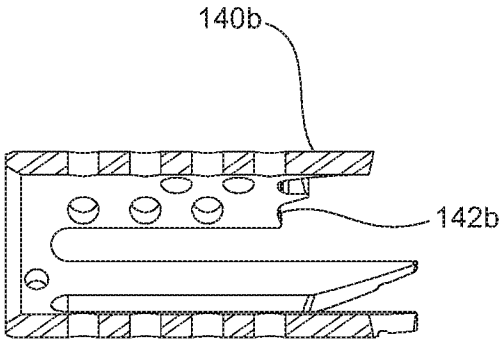
Figure 12:
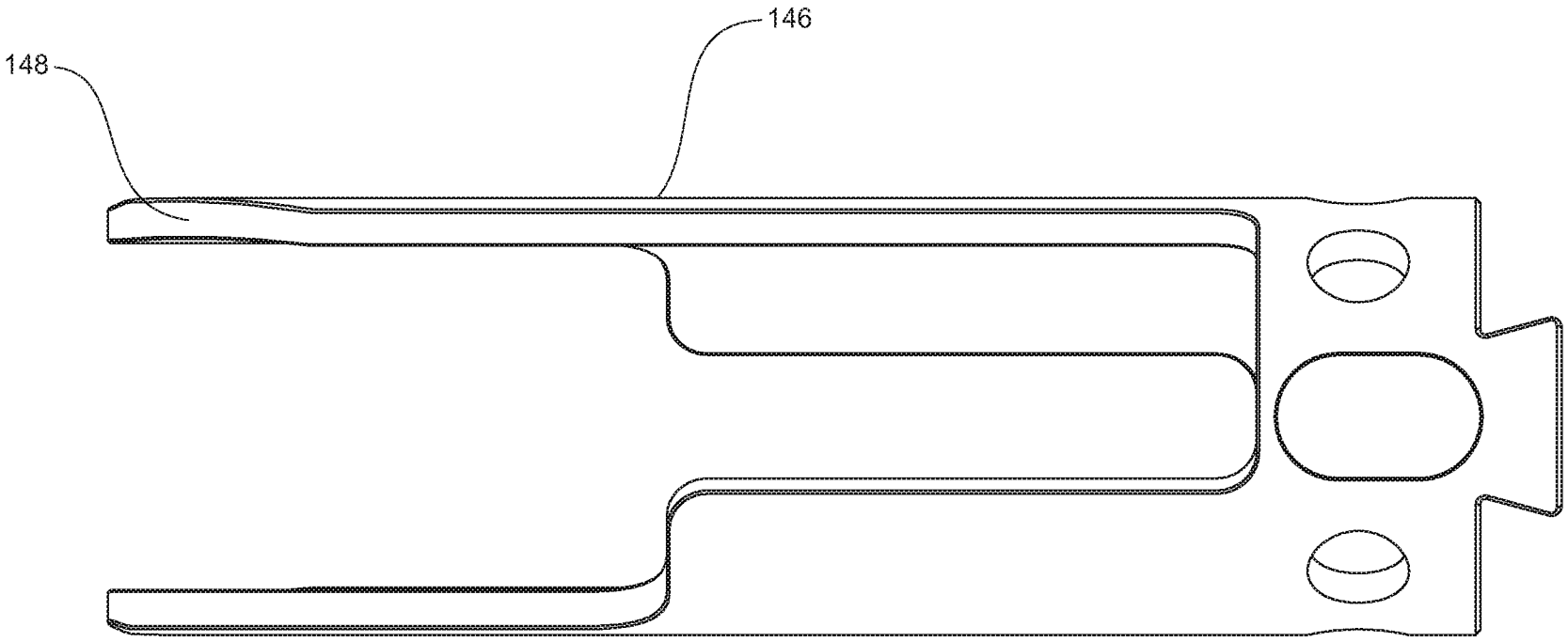
FIG. 12 is a side elevation view of a downhole J-Mechanism of an embodiment of a BHA.

FIG. 9 is a representation of the first and second J-Profiles 142,148 and the various positions of the J-Pins 144,150 therein. FIG. 10A depicts the first and second J-Mechanisms 140,146 in isolation. FIGS. 10B-10H depict an upper portion 140*a* of the first J-Mechanism 140 having upper profile 142*a* and various cross-sections thereof, FIGS. 11A-11D depict a lower portion 140*b* of the first J-Mechanism 140 having lower profile 142*b* and various cross-sections thereof, and FIG. 12 depicts the second J-Mechanism 146.

Having reference to corresponding FIGS. 5, 6A, 7A, and 9, at the commencement of shifting operations to shift a target sleeve 162 to the open position for fracturing (step 210 of FIG. 5), the BHA 110 is RIH to below the target sleeve 162 (step 220). As the BHA 110 is RIH, it is actuated to the RIH mode, wherein the first J-Pin 144 is cycled to an extreme downhole position D1 in the first J-Profile 144, and the second J-Pin 150 is not engaged with the second J-Profile 148. The arms 128 and dogs 130 are retained inwardly to allow the BHA 110 to move through the casing string 6 and sleeve 162 without engagement therewith.

Figure 7A:
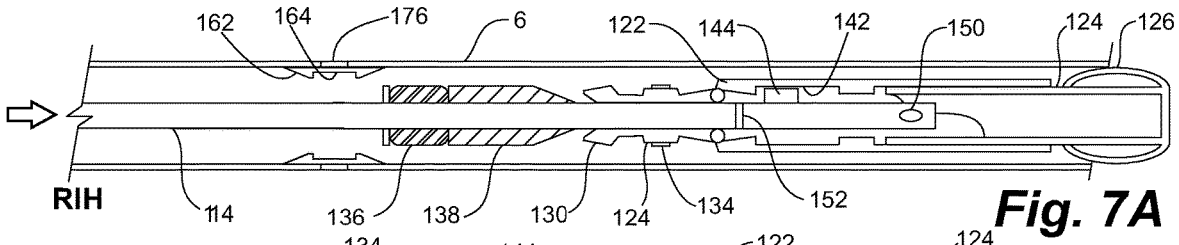
FIGS. 7A to 7H correspond with FIGS. 6A to 6H, and illustrate cross-sectional views of one embodiment of an entire BHA. The diameter of the views has been exaggerated to better illustrate the annular components. The BHA shown is left to right from the uphole conveyance string down to the downhole drag beam end, the BHA configuration further shown in a sequence of steps for opening and closing the ports focused on the movement of upper and lower J-pins in upper and lower J-Profiles of a dual J-slot mechanism and movement of a slack sub connecting between the dual J-slot mechanism and the drag beam or block, more particularly, FIG. 7A corresponds with FIG. 6A and illustrates the BHA in RIH mode.
Figure 7B:
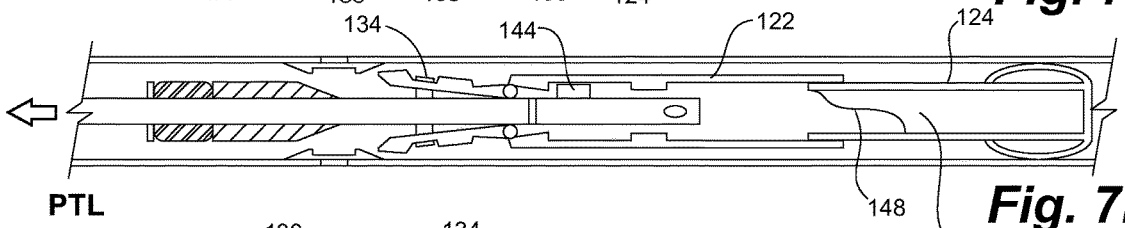
Figure 7C:
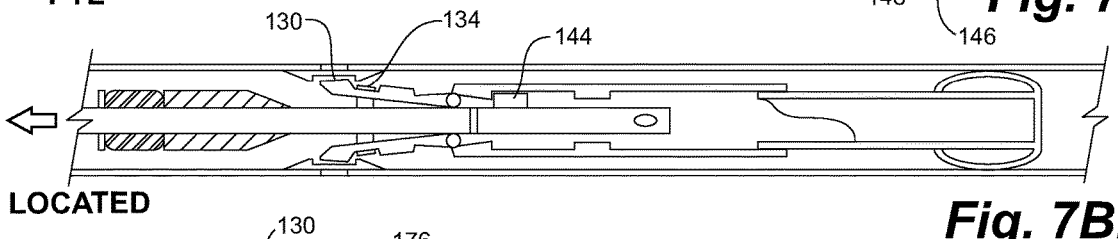
Figure 7C:
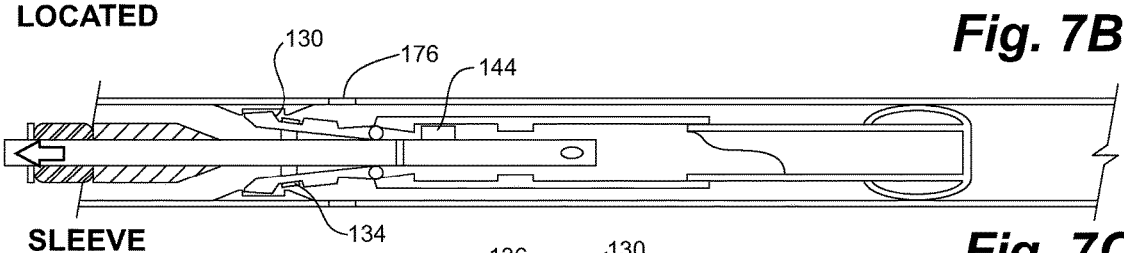
Figure 7D:
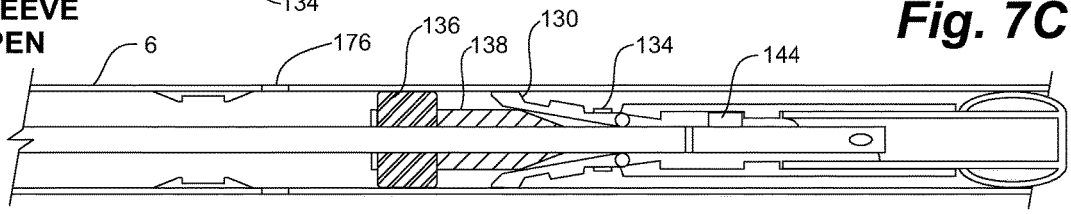
Figure 7E:
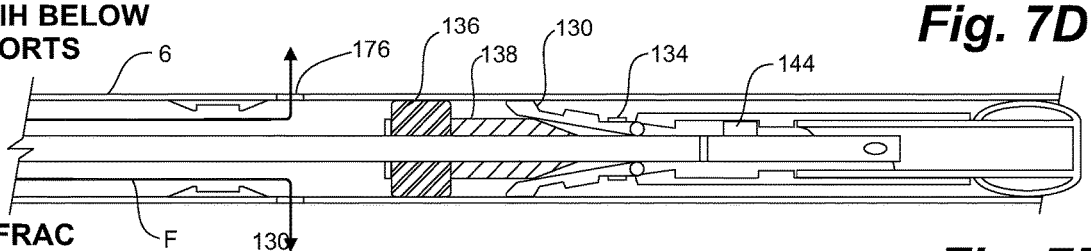
Figure 7F:
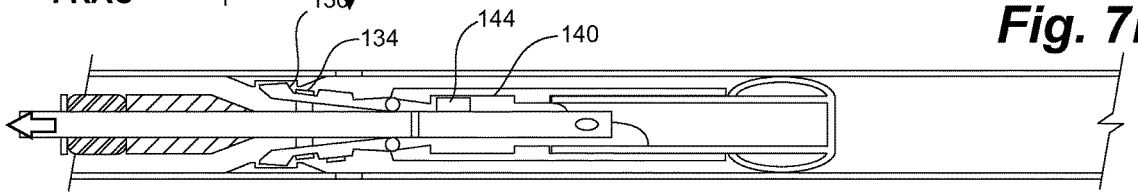
Figure 7G:
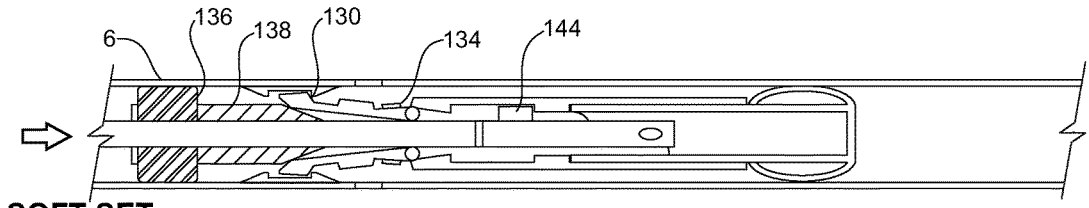
Figure 7H:
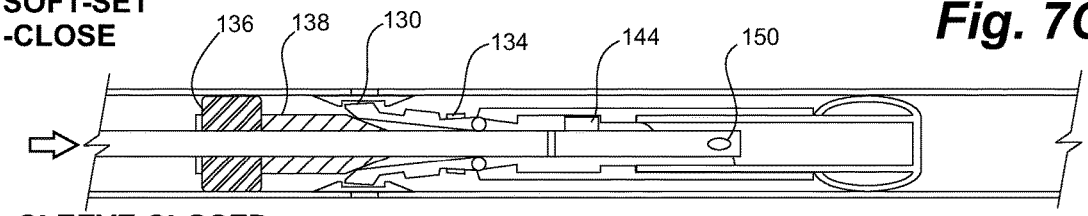
Figure 7H:
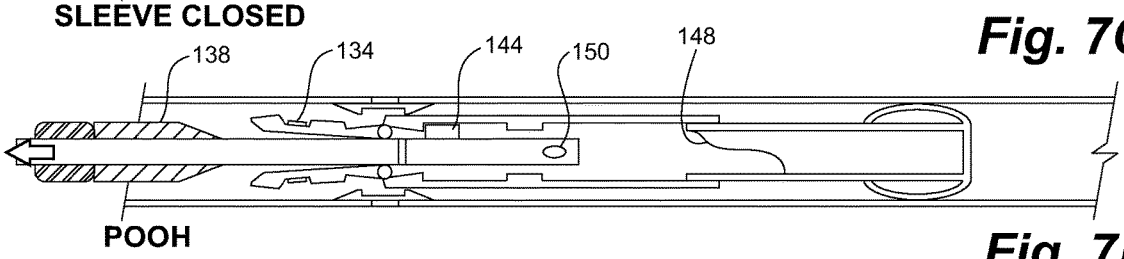

Having reference to corresponding FIGS. 5, 6B, 7Bi, 7Bii, 8Bi, 8Bii, the conveyance string 8, BHA mandrel 114 and first BHA housing portion 122 are pulled uphole to actuate the BHA 110 to the PTL mode (step 230), wherein the first J-Pin 144 is cycled to an extreme uphole position U1 in the first J-Profile 142, and the second J-Pin 150 remains unengaged with the second J-Profile 148. The second BHA housing portion 124, connected to the drag block 126, is held in position in the casing string 6, causing the first housing portion 122 to telescope to the extended position. In the PTL mode, the arms 128 and dogs 130 are released radially outwardly, in a biased condition, to allow the dogs 130 to locate the sleeve profile 164 and engage the uphole shoulder 166 at the uphole end thereof. The BHA 110 can be pulled uphole until the dogs 130 have located the profile 164 of the sleeve 162 (step 240). Engagement is generally observed as a weight change at surface, in particular a weight increase.

With reference to FIGS. 5, 6C, 7C, and 9, once the dogs 130 have engaged with the sleeve profile 164 and uphole shoulder 166 thereof (step 250), a continued uphole pull exceeding a requisite sleeve opening force overcomes the first retainer or detent 170, and shifts the sleeve 162 uphole to open the ports 176 in the sleeve housing 174 (step 260).

After the sleeve 162 has been shifted to the open position, the dogs 130 remain engaged with the sleeve 112 and must be released. 136. Further, the packer 136 of the BHA 110 cannot be actuated with the dogs 130 still engaged with the sleeve profile 164, as the packer 136 will set too high, such as improperly at about the ports 118, and fracturing can be compromised. This is due to short CSS sleeve assembly 160 not providing sufficient axial length to accommodate the packer 136. Thus, the BHA 110 must be lowered downhole to position the packer 136 downhole of the sleeve assembly 160, such that it may be set against the casing string 6 in preparation for the fracturing treatment of the formation surrounding the sleeve assembly 160.

Having reference to corresponding FIGS. 5, 6D, 7D, 7E, 8Di, 8Dii, and 9, to reposition the packer 136 of the BHA 110 downhole of the sleeve assembly 160, the mandrel 114 is lowered and the BHA 110 is cycled to the RIHBe mode, which is an intermediate mode between the PTL mode and the SET-FRAC mode (step 270). In the RIHBe mode, the first J-Pin 144 engages an RIHBe stop of the first J-Profile 142 at an intermediate downhole position D1 such that the first housing portion 122 moves downhole with the mandrel 114 toward the second housing portion 124. The engagement of the first J-Pin 144 against the RIHBe stop drives the first housing portion 122 downhole with the mandrel 114, collapsing the telescoping slack sub and permitting the BHA mandrel 114 and first housing portion 122, together with the second J-Pin 150, to approach the second housing portion 124 and its second J-profile 148, which are held stationary in the casing 6 by the drag block 126. The first J-Mechanism 140 and first J-Profile 142 retain the first J-Pin 144 and BHA mandrel 114 in the intermediate RIHBe mode, spacing the mandrel's cone 138 from the BHA housing's arms 128 for free movement downhole. In the RIHBe mode, the arms 128 are restrained radially inward such that the dogs 130 are released from the sleeve profile 164, the cone 138 is prevented from engaging the arms 128 to drive them radially outward, and the packer 136 is prevented from setting. The dogs 130 and packer 136 are lowered with the first housing portion 122 and mandrel 114 below the ports 176 to avoid setting too high in the casing string 6. The position of the first J-Pin 144 in the intermediate position D1 of the first J-Profile 148 is only temporarily maintained by the RIHBe stop in the first J-Profile 148.

As the mandrel 114 and first housing portion 122 are lowered, the second J-Pin 150 approaches the second J-Mechanism 146 of the second housing portion 124 and engages with the second J-Profile 148 thereof.

As shown in corresponding FIGS. 6E, 7D, 7E, and 8E, as the BHA housing portions 122,124 collapse, the second J-Pin 150 engages the second J-Profile 148, which in turn causes the first J-Pin 144 to disengage with the RIHBe stop and permits the first J-Pin 144 to cycle into the extreme downhole position D2H corresponding with the SET-FRAC mode of the BHA 110. The second J-Pin 50 eventually bottoms out in the second J-Profile 148, at which point the dogs 130 and packer 136 are positioned below the ports 176 of the sleeve assembly 162. The disengagement of the first J-Pin 144 with the RIHBe stop of the first J-Profile 142 permits the mandrel 114 to resume telescoping within the first housing 122 downhole to drive the cone 138 under the arms 128 and set the dogs 130 in the casing string 6 below the sleeve assembly 160. The engagement of the cone 138 and dogs 130 drives the dogs 130 into the casing 6 to act as slips and axially secure the first housing 122 in the casing 6, and enables compression of the packer 136 by the mandrel 114 for isolating the bore in the casing string 6 below the ports 176.

From surface, pumps are operated to pump fluids F down the annulus between the conveyance string 8 and casing 6 and through the open ports 176 to the formation (step 280). Once the frac has been completed, and depending on the operator instructions to permit the formation to rest and minimize proppant flowback, the BHA 110 can be operated to shift the sleeve 162 back downhole to the closed position to block fluid flow through the ports 176, as described herebelow.

Thereafter, as shown in corresponding FIGS. 5, 6F, 7F, and 8F, the BHA 110 is pulled uphole and cycled to the pull-to-relocate (PTR) mode (step 290), in which the first J-Pin 144 is once again in the extreme uphole U1 position in the first J-Profile 142, and the second J-Pin 150 is engaged with an uphole retaining stop RET of the second J-Profile 148. In the PTR mode, the first and second housing portions 122,124 are retained in the collapsed position, the mandrel 114 dragging the first and second housing portions 122,124 uphole by virtue of the engagement of the first and second J-Pins 144,150 with the first and second J-Profiles 142,148, and the dogs 130 are biased outwardly for relocating the sleeve profile 164 of the opened sleeve 162. The BHA 110 is pulled uphole in the PTR mode until the dogs 130 reengage the sleeve profile 164. However, unlike the PTL sleeve opening sequence, the BHA housing portions 122, 124 are held in the collapsed position.

Thereafter, having reference to corresponding FIGS. 5, 6G, 7Gi, 7Gii 8Gi and 8Gii, the BHA mandrel 114 is again run in downhole to cycle the BHA 110 to the SOFT-SET-CLOSE mode (step 300), the BHA mandrel 114 being guided to the near-extreme downhole position D2S of the first J-Profile 142 which, as shown in FIG. 11, is not located as far downhole as the D2H position corresponding with the SET-FRAC mode. The elongated cone 138 is thus only partially engaged under the arms 128, locking the dogs 130 radially outwardly in the sleeve profile 164 and the packer 136 is partially engaged. As such, partially expanded packer 136 is not engaged firmly with the casing wall 6 and does not axially retain the BHA 110 to the casing string 6. Due in part to the axial elongation of the cone 138 and the geometry of the sleeve assembly 160, the packer 136 remains in the casing string 6 above the sleeve assembly 160 and the packer 136 is only in a partially actuated condition. Thereafter, surface pumps are operated to apply fluid pressure P to the annulus, the pressure against the casing-blocking, partially expanded packer 136 providing a downward force to shift the packer 136 and the BHA 110 downhole and close the sleeve 162, which is engaged with the dogs 130 (step 310).

Thereafter, as shown in FIGS. 5, 6H, 7H, and 8H, once the sleeve 162 has been closed, the BHA 110 is again pulled uphole to cycle the BHA 110 to the POOH mode, and the first J-Pin 144, together with the mandrel 114, is cycled to the intermediate-uphole U2 position in the first J-Profile 142 (step 320). The second J-Pin 150, having been released from the RET stop of the second J-Profile 148, is disengaged from the second J-Mechanism 146. The first BHA housing portion 122 telescopes uphole from the second BHA housing portion 124 to the extended position. The intermediate-uphole U2 position releases the packer 136 from its partially actuated condition and constrains the arms 128 and dogs 130 in the radially inward position, thereby disengaging the dogs 30 from the sleeve profile 164. BHA 110 can then be pulled freely uphole in the POOH mode to below the next sleeve 162 to be opened and/or closed. As the BHA 110 is pulled uphole, the housing portions 122,124 telescope to the extended position.

We claim:

1. A shifting tool for sleeve valves along a wellbore, each sleeve valve having a sleeve housing having a bore fit with an axially shiftable sleeve within, the sleeve having an annular sleeve profile formed therealong, the shifting tool comprising:

a first housing portion having a first shifting mechanism;

a second housing portion having a second shifting mechanism, the second housing portion telescopically connected to the first housing portion and adapted for axially telescoping between a collapsed position and an extended position;

a drag block connected to the second housing portion and adapted for resisting axial movement the second housing portion in the wellbore;

a mandrel having a first shifting member adapted to cooperate with the first shifting mechanism, a second shifting member adapted to selectably cooperate with the second shifting mechanism, and a retaining member;

one or more sleeve engagement members supported on one or more pivotable arms, the one or more arms supported by the first housing portion, each of the one or more pivotable arms being radially actuable by the retaining member between at least a radially outward position and a radially inward collapsed position.

2. The shifting tool of claim 1, wherein the first shifting mechanism and second shifting mechanism cooperate to delineate a plurality of operational modes of the shifting tool.

3. The shifting tool of claim 2, wherein the mandrel comprises one or more sealing elements and a cone, and the plurality of operational modes comprises at least:

a run-in-hole (RIH) mode, wherein the first shifting member is at a first intermediate downhole position to shift the one or more arms to the radially inward position;

a pull-to-locate (PTL) mode, wherein the first shifting member is at a first extreme uphole position to shift the one or more arms to the radially outward position;

a RIHBe mode, wherein the first shifting member is at a second intermediate downhole position and engaged with a RIHBe stop of the first shifting mechanism to actuate the first housing portion to the collapsed position and position the one or more sealing elements downhole of the sleeve valve;

a SET-FRAC mode, wherein the first shifting member is at an extreme downhole position to drive the cone into the one or more pivotable arms radially outward and activate the one or more sealing elements;

a pull-to-relocate (PTR) mode, wherein the first shifting member is located at a second extreme uphole position to shift the one or more pivotable arms to the radially outward position, and the second shifting member engages a retaining stop of the second shifting mechanism to maintain the first housing portion in the collapsed position;

a SOFT-SET-CLOSE mode, wherein the first shifting member is located at a near-extreme downhole position to partially activate the one or more sealing elements; and a pull-out-of-hole (POOH) mode, wherein the first shifting member is at an intermediate uphole position to shift the one or more pivotable arms to the radially inward position for pulling out of hole.

4. The shifting tool of claim 3, wherein a stroke length travelled by the first housing portion when actuating between the extended position and the collapsed position is sufficient for the one or more sealing elements to be axially positioned downhole of the sleeve valve when the shifting tool has located the sleeve valve and is actuated from the extended position to the collapsed position.

5. The shifting tool of claim 4, wherein the stroke length is equal to or greater than an axial distance between the one or more sealing elements and the ports immediately after the shifting tool has actuated the sleeve to an open position.

6. The shifting tool of claim 2, wherein the plurality of operational modes comprise at least one mode wherein the second shifting member is not engaged with the second shifting mechanism to allow the first and second housing portions to telescope freely between the collapsed and extended positions.

7. The shifting tool of claim 2, wherein the plurality of operational modes comprise at least one mode wherein the second shifting member is engaged with one or both of the second shifting mechanism and the second housing portion to maintain the first and second housing portions in the collapsed position.

8. The shifting tool of claim 1, wherein the activation mandrel is connected to a conveyance string and axially manipulated thereby, the activation mandrel extending slidably through the upper housing and lower housing.

9. The shifting tool of claim 1, wherein the first and second shifting mechanisms are first and second J-Mechanisms having respective first and second J-Profiles, and the first and second shifting members are first and second J-Pins connected to the mandrel and engaging with the first and second J-Profiles.

10. A method for treating a wellbore completed with a completion string having a plurality of sleeve valves therealong, each sleeve valve having a sleeve housing and an axially shiftable sleeve, each sleeve having an annular profile intermediate the sleeve, comprising:

selecting a target sleeve valve for treatment, the target sleeve valve being closed;

running a shifting tool downhole in a run-in-hole (RIH) mode by actuating a mandrel axially relative to a housing portion, the housing portion supporting one or more radially pivotable arms, each arm bearing a sleeve engaging member, and a drag block connected to the housing portion and adapted for resisting axial movement of the housing portion in the wellbore, the one or more pivotable arms shifted to a radially inward position and positioning the shifting tool downhole of the selected sleeve valve;

shifting the shifting tool uphole to a pull-to-locate (PTL) mode, the one or more pivotable arms shifted to a radially outward biased position, locating the annular profile of the sleeve of the target sleeve valve and engaging the sleeve engaging elements therewith, and shifting the target sleeve valve uphole to an open position;

shifting the shifting tool downhole to a SET-FRAC mode, the housing portion actuated to position one or more sealing elements of the shifting tool downhole of the target sleeve valve for treating the wellbore;

shifting the shifting tool uphole to a pull-to-relocate (PTR) mode, the one or more pivotable arms shifted to the radially outward biased position, and pulling the shifting tool uphole for locating the annular profile of the sleeve of the target sleeve valve and engaging the sleeve engaging elements therewith;

shifting the shifting tool downhole to a SOFT-SET-CLOSE mode, the one or more sealing elements partially activated and the sleeve-engaging elements locked in engagement with the target sleeve;

applying fluid pressure in an annulus between the shifting tool and the completion string to apply a downhole force on the shifting tool to shift the target sleeve valve to a closed position; and shifting the tool to a pull-out-of-hole (POOH), the one or more arms in the radially inward collapsed position for pulling the shifting tool out of hole to a subsequent uphole sleeve valve.

11. The method of claim 10, wherein:

the shifting the shifting tool downhole to the SET-FRAC mode for actuating the housing portion to position one or more sealing elements of the shifting tool downhole of the target sleeve valve further comprises telescopically collapsing a first uphole housing portion of the housing portion into a second downhole housing portion, movement of the second housing portion resisted by the drag block; and shifting of the shifting tool uphole to the PTL mode further comprises telescopically extending the first uphole housing of the housing portion from the second downhole housing portion, movement of the second housing portion resisted by the drag block.

12. The method of claim 11, wherein a stroke length of the axial collapsing of the first uphole housing portion into second downhole housing portion is sufficient for positioning the one or more sealing elements of the shifting tool downhole of the target sleeve valve.

13. A treatment system comprising:

a completion string having a plurality of sleeve valves therealong, each sleeve valve having a sleeve housing having one or more ports and a bore fit with an axially shiftable sleeve, each sleeve having an annular profile formed intermediate the sleeve; and a shifting tool having:

a first housing portion having a first shifting mechanism;

a second housing portion having a second shifting mechanism, the second housing portion telescopically connected to the first housing portion and adapted for axially telescoping between a collapsed position and an extended position;

a drag block connected to the second housing portion and adapted for resisting axial movement the second housing portion in the wellbore;

a mandrel having a first shifting member adapted to cooperate with the first shifting mechanism, a second shifting member adapted to selectably cooperate with the second shifting mechanism, a retaining member, one or more sealing elements, and a cone; and one or more sleeve engagement members supported on one or more pivotable arms, the one or more arms supported by the first housing portion, each of the one or more pivotable arms being radially actuable by the retaining member between at least a radially outward position and a radially inward position.

14. The system of claim 13 wherein the axial length of the sleeve valve is less than the combined axial length of the one or more sealing elements, the cone, and the one or more sleeve engagement members.

15. The system of claim 13, wherein the first shifting mechanism and second shifting mechanism cooperate to delineate a plurality of operational modes of the shifting tool.

16. The system of claim 15, wherein the plurality of operational modes comprises at least:

a run-in-hole (RIH) mode, wherein the first shifting member is at a first intermediate downhole position to shift the one or more arms to the radially inward position;

a pull-to-locate (PTL) mode, wherein the first shifting member is at a first extreme uphole position to shift the one or more arms to the radially outward position;

a RIHBe mode, wherein the first shifting member is at a second intermediate downhole position and engaged with a RIHBe stop of the first shifting mechanism to actuate the first housing portion to the collapsed position and position the one or more sealing elements downhole of the sleeve valve;

a SET-FRAC mode, wherein the first shifting member is at an extreme downhole position to drive the cone into the one or more pivotable arms radially outward and activate the one or more sealing elements;

a pull-to-relocate (PTR) mode, wherein the first shifting member is located at a second extreme uphole position to shift the one or more pivotable arms to the radially outward position, and the second shifting member engages a retaining stop of the second shifting mechanism to maintain the first housing portion in the collapsed position;

a SOFT-SET-CLOSE mode, wherein the first shifting member is located at a near-extreme downhole position to partially activate the one or more sealing elements; and a pull-out-of-hole (POOH) mode, wherein the first shifting member is at an intermediate uphole position to shift the one or more pivotable arms to the radially inward position for pulling out of hole.

17. The system of claim 16, wherein a stroke length travelled by the first housing portion when actuating between the extended position and the collapsed position is sufficient for the one or more sealing elements to be axially positioned downhole of the sleeve valve when the shifting tool has located the sleeve valve and is actuated from the extended position to the collapsed position.

18. The system of claim 17, wherein the stroke length is equal to or greater than an axial distance between the one or more sealing elements and the ports immediately after the shifting tool has actuated the sleeve to an open position.

19. The system of claim 15, wherein the plurality of operational modes comprise at least one mode wherein the second shifting member is not engaged with the second shifting mechanism to allow the first and second housing portions to telescope freely between the collapsed and extended positions.

20. The system of claim 15, wherein the plurality of operational modes comprise at least one mode wherein the second shifting member is engaged with one or both of the second shifting mechanism and the second housing portion to maintain the first and second housing portions in the collapsed position.

21. The system of claim 13, wherein the activation mandrel is connected to a conveyance string and axially manipulated thereby, the activation mandrel extending slidably through the upper housing and lower housing.

22. The system of claim 13, wherein the first and second shifting mechanisms are first and second J-Mechanisms having respective first and second J-Profiles, and the first and second shifting members are first and second J-Pins connected to the mandrel and engaging with the first and second J-Profiles.

* * * * *